US006234770B1

(12) United States Patent
Ridley et al.

(10) Patent No.: US 6,234,770 B1
(45) Date of Patent: May 22, 2001

(54) RESERVOIR FLUIDS PRODUCTION APPARATUS AND METHOD

(75) Inventors: Rodney K. Ridley, Edmonton; Mario DeRocco, Leduc, both of (CA)

(73) Assignee: Alberta Research Council Inc., Alberta (CA)

( * ) Notice: Subject to any disclaimer, the term of this patent is extended or adjusted under 35 U.S.C. 154(b) by 0 days.

(21) Appl. No.: 09/158,668

(22) Filed: Sep. 22, 1998

Related U.S. Application Data

(63) Continuation-in-part of application No. 08/620,941, filed on Mar. 22, 1996, now Pat. No. 5,860,795.

(51) Int. Cl.[7] ..... F04B 17/00
(52) U.S. Cl. ..... 417/408; 418/48
(58) Field of Search ..... 417/403, 399, 417/401, 534, 53, 406, 408; 418/48

(56) References Cited

U.S. PATENT DOCUMENTS

| | | | | |
|---|---|---|---|---|
| 1,783,425 | | 12/1930 | Hunter . | |
| 2,132,738 | | 10/1938 | Knox . | |
| 2,136,229 | | 11/1938 | Baldwin et al. . | |
| 2,296,582 | | 9/1942 | Sproull . | |
| 2,325,256 | * | 7/1943 | Leonard | 103/5 |
| 2,910,002 | | 10/1959 | Morgan . | |
| 3,374,746 | | 3/1968 | Chenault . | |
| 3,410,217 | | 11/1968 | Kelley et al. . | |
| 3,617,152 | | 11/1971 | Cummings . | |
| 3,635,125 | | 1/1972 | Rosen et al. . | |
| 3,720,484 | | 3/1973 | Kirshsieper . | |
| 3,887,008 | | 6/1975 | Canfield . | |
| 4,086,030 | * | 4/1978 | David | 417/88 |
| 4,171,016 | | 10/1979 | Kempton . | |
| 4,465,435 | | 8/1984 | Copas . | |
| 4,589,494 | | 5/1986 | Sakoda . | |
| 4,596,516 | | 6/1986 | Scott et al. . | |
| 4,676,308 | | 6/1987 | Chow et al. . | |
| 4,700,783 | | 10/1987 | Baron . | |
| 5,006,046 | | 4/1991 | Buckman et al. . | |
| 5,339,905 | | 8/1994 | Dowker . | |
| 5,366,353 | | 11/1994 | Hand . | |
| 5,417,281 | * | 5/1995 | Wood et al. | 417/68 |
| 5,611,397 | * | 3/1997 | Wood | 166/68 |

FOREIGN PATENT DOCUMENTS

| | | |
|---|---|---|
| 1167760 | 5/1984 | (CA) . |

* cited by examiner

*Primary Examiner*—Timothy S. Thorpe
*Assistant Examiner*—Ehud Gartenberg
(74) *Attorney, Agent, or Firm*—Rodman & Rodman

(57) ABSTRACT

The invention is an apparatus for moving reservoir fluids from an underground reservoir using a wellbore extending from the surface to an end beneath the surface, wherein the wellbore communicates with the reservoir such that reservoir fluids enter the wellbore and separate into a liquid phase and a gas phase at a gas pressure. The apparatus includes a first pump, for containing within the wellbore in communication with the liquid, for pumping the liquid phase. The apparatus further includes a pump drive, for containing within the wellbore, operably connected to the first pump for driving the first pump. The pump drive is powered using the gas pressure of the gas phase in the wellbore. An intake communicates with the gas phase in the wellbore and directs the gas phase to the pump drive in order to power the pump drive, while an exhaust directs the gas phase from the pump drive. Further, the invention is a method for moving reservoir fluids from an underground reservoir using a wellbore. The method includes the steps of intaking the gas phase from the wellbore into the pump drive, powering the pump drive using the gas pressure of the gas phase in the wellbore, pumping the liquid phase from the wellbore by the first pump and exhausting the gas phase from the pump drive.

10 Claims, 11 Drawing Sheets

RESERVOIR FLUIDS PRODUCTION APPARATUS AND METHOD

This application is a continuation-in art of U.S. patent application Ser. No. 08/620,941 filed on Mar. 22, 1996 now U.S. Pat. No. 5,860,795.

TECHNICAL FIELD

The present invention relates to an apparatus and a method for moving reservoir fluids, having a liquid phase and a gas phase at a gas pressure, from an underground reservoir with the use of a wellbore, using a downhole pump powered by the gas pressure of the gas phase of the reservoir fluids.

BACKGROUND ART

The removal of liquids which accumulate in producing wells is required in order to enhance production from the well and the overall operation of the production system. In particular, liquids removal is necessary for the dewatering of gas wells and the removal of oil from wells where mixed oil and gas exists in the underground reservoir. If the liquids, such as water and/or oil, are not removed, the liquids tend to accumulate and fill or load up the well, which restricts the flow of the gas to the surface. Eventually, the liquids will choke off gas production completely. Therefore, the problem to be overcome is to remove the liquids continually to avoid their accumulation in the well.

One approach to this problem is to use a gas lift system which uses the natural gas pressure in the reservoir to lift the liquids from the well. In a gas lift system, a tubing string is typically located in the well which extends from the surface into the accumulated liquids such that the accumulated liquids may flow into the tubing string. The gas then enters the tubing string from the underground reservoir at chosen intervals along the tubing string to cause the liquids within the tubing string to rise to the surface. A freely moveable plunger or pig may be located in the tubing string to minimize the penetration of the gas through the liquids. Where the gas lift system uses the pressurized gas from the reservoir to transport slugs of the liquid to the surface, a small diameter tubing string for producing the liquids is often required so that the gas pressure and the gas velocity are sufficient to carry the liquids to the surface. However, the requirement for small diameter tubing may significantly restrict the flow of the liquids and reduce the gas production. As well, the gas and the liquids are typically well mixed at the surface, which may cause problems in surface production lines, such as hydrate formation or freezing. Further, gas lift systems have been found to be unsuitable where the downhole gas pressure or the gas velocity is low and thus, the gas is unable to overcome the pressure head of the liquids to carry the liquids to the surface.

Further gas lift systems have been designed which only periodically or intermittently lift the liquids to the surface in a cyclical operation in order to allow the natural gas pressure to develop in the well between the cycles to a critical level necessary to lift the liquids. Examples of such systems include U.S. Pat. No. 2,136,229 issued May 16, 1938 to Baldwin et al, U.S. Pat. No. 4,596,516 issued Jun. 24, 1986 to Scott et al and U.S. Pat. No. 4,465,435 issued Aug. 14, 1984 to Copas. Some of these systems use a timer operated valve, located in the outlet of the tubing containing the liquids. The valve is set to periodically open at a timed interval equal to the time required for the natural gas pressure in the well to recover following the release of such pressure. Other systems use valves sensitive to a predetermined differential pressure between the liquids in the tubing string and the gas to control the periodic opening of the valve to allow lifting of the liquids by the gas.

Other gas lift systems introduce pressurized gas into the well from an outside source in addition to the natural gas from the reservoir, as shown in U.S. Pat. No. 2,132,738 issued Oct. 11, 1938 to Knox. However, the introduction of the pressurized gas into the well to lift the liquids requires the use of a compressor which tends to increase both the cost and complexity of the production apparatus required.

A further approach to the problem of liquid loading is shown in Canadian Patent No. 1,167,760 issued May 22, 1984 to Prather which describes a reciprocating surface pump which is powered by the natural gas pressure from the reservoir. The reciprocating surface pump is connected to a string of sucker rods which are connected to a conventional downhole pump. In essence, the gas from the well is conducted to the surface where is drives the reciprocating surface pump. The reciprocating pump then powers the downhole pump, which pumps the liquids to the surface. Several disadvantages are exhibited by this system. First, the system requires a reciprocating pump at the surface. Second, as the gas is conducted to the surface for powering the reciprocating pump, the reciprocating pump must be designed as a pressure vessel able to withstand the pressure differential between the atmosphere and the downhole pressure. As well, there may be some energy loss as the gas travels from the bottom of the well to the reciprocating surface pump. Third, reciprocation of the sucker rods within the tubing string results in wearing of the tubing string and energy loss due to friction between the sucker rods and the tubing string.

There is therefore a need in the industry for an improved apparatus and method for moving liquids contained in an underground reservoir using a wellbore, which apparatus is powered by the pressure of the gas naturally contained within the reservoir. Further, there is a need for the apparatus to be contained downhole when in operation such that the apparatus creates a mechanical advantage for pumping the liquids and directing the gases either towards the surface or towards a downhole location such as a reservoir.

DISCLOSURE OF INVENTION

The present invention relates to an apparatus, and a method using the apparatus, for moving reservoir fluids, having a liquid phase and a gas phase at a gas pressure, from an underground reservoir using a wellbore, the apparatus being powered using the gas pressure of the gas phase. Furthermore, the present invention relates to the apparatus including a pump powered using the gas pressure of the gas phase, for containing in the wellbore during its operation, for pumping the liquid phase and directing the gas phase either towards the surface or towards a downhole location such as a reservoir.

In the apparatus form of the invention, the invention is comprised of an apparatus for moving reservoir fluids from an underground reservoir using a wellbore having an inner wall and extending from the surface to an end beneath the surface, wherein the wellbore communicates with the reservoir such that the reservoir fluids enter the wellbore and separate into a liquid phase and a gas phase at a gas pressure. The apparatus is comprised of:

(a) a first pump, for containing within the wellbore in communication with the liquid phase, for pumping the liquid phase;

(b) a pump drive, for containing within the wellbore and operably connected to the first pump, for driving the first pump, wherein the pump drive is powered using the gas pressure of the gas phase in the wellbore;

(c) an intake for communicating with the gas phase in the wellbore and for directing the gas phase to the pump drive in order to power the pump drive; and (d) an exhaust for directing the gas phase from the pump drive.

Preferably, the wellbore is comprised of a lower wellbore section and an upper wellbore section, wherein the lower wellbore section is adjacent the end of the wellbore, contains the first pump and the pump drive and communicates with the reservoir, and wherein the upper wellbore section extends from the surface to the lower wellbore section. Further, the wellbore may be cased, in that a casing lines the inner wall of the wellbore. Where the entire wellbore is cased, including the lower wellbore section, the casing defines a plurality of perforations in the lower wellbore section for communication between the reservoir and the lower wellbore section.

The apparatus preferably includes means for controlling the release of the gas phase within the wellbore so that the gas phase is available to power the pump drive. These controlling means may be comprised of any barrier, seal or other structure capable of performing this function. However, the controlling means are preferably comprised of a packer which sealingly engages the inner wall of the wellbore between the upper wellbore section and the lower wellbore section. In such a case, the exhaust may direct the gas phase from the pump drive past the packer either towards the surface or towards a downhole location such as a reservoir.

Further, the exhaust may be comprised of at least one exhaust conduit and the upper wellbore section. The exhaust conduit releases the gas phase from the pump drive into the upper wellbore section and the upper wellbore section directs the gas phase. In this instance, the upper wellbore section is preferably cased such that the exhaust conduit releases the gas phase into the upper wellbore section so that the casing directs the gas phase, preferably towards the surface.

The pump drive can be any type of drive system that can be powered using the gas pressure of the gas phase in the wellbore, so long as it is compatible with the first pump. In the preferred embodiment, the pump drive defines at least one chamber having an upper end, a lower end and an inner side surface. Further, the pump drive is preferably comprised of:

(a) a reciprocating drive shaft passing through the upper end and the lower end of the chamber and operably connected to the first pump such that reciprocation of the drive shaft drives the first pump in order to pump the liquid phase;

(b) a moveable piston, sealingly engaging the inner side surface of the chamber to divide the chamber into an upper chamber section and a lower chamber section, wherein the piston is connected to the drive shaft such that movement of the piston in the chamber reciprocates the drive shaft;

(c) first means for moving the piston using the gas pressure from a first position adjacent the upper end of the chamber to a second position adjacent the lower end of the chamber; and (d) second means for moving the piston using the gas pressure from the second position to the first position.

In an alternate embodiment, the pump drive is comprised of a turbine having a rotary drive shaft extending longitudinally therethrough which is powered using the gas pressure of the gas phase in the wellbore, the rotary drive shaft being operably connected to the first pump such that rotation of the drive shaft drives the first pump in order to pump the liquid phase.

In the preferred embodiment, the first moving means may be comprised of a first conduit for directing the gas phase into the upper chamber section to cause the piston to move towards the second position. Further, the second moving means may be comprised of a second conduit for directing the gas phase into the lower chamber section to cause the piston to move towards the first position. Where the apparatus includes a first conduit and a second conduit, the intake alternately directs the gas phase from the lower wellbore section into the first conduit and the second conduit such that the gas pressure causes the piston to alternately move between the first position and the second position.

The first pump may be any type of pump capable of pumping the liquid phase, such as a rotary pump or a reciprocating pump. However, in the preferred embodiment, the first pump is a reciprocating pump having a first pump shaft operably connected to the drive shaft. In the alternate embodiment, the first pump is a rotary pump having a first pump shaft operably connected to the drive shaft.

Further, the intake preferably includes a switch for alternately directing the gas phase from the lower wellbore section into the first conduit and the second conduit. In the preferred embodiment, the switch is comprised of a switching valve for alternately directing a first flow of the gas phase from the lower wellbore section into the first conduit and the second conduit and a main valve for guiding a second flow of the gas phase from the lower wellbore section to the switching valve for actuation of the switching valve. Further, the intake may define a cavity, having an upper end, a lower end and an inner side surface. The cavity preferably contains the switching valve such that the switching valve sealingly engages the inner side surface of the cavity to divide the cavity into an upper cavity section, adjacent the upper end of the cavity, and a lower cavity section, adjacent the lower end of the cavity. In this case, the switching valve is moveable within the cavity between a first state, in which the first flow of the gas phase is directed into the first conduit, and a second state, in which the first flow of the gas phase is directed into the second conduit. Further, the main valve alternately directs the second flow of the gas phase to the upper cavity section and the lower cavity section such that the gas pressure causes the switching valve to move between the first state and the second state.

Finally, the apparatus may also include a second pump, for containing within the upper wellbore section, for pumping a condensate liquid contained in the upper wellbore section either towards the surface or towards a downhole location such as a reservoir. The second pump may be any type of pump capable of pumping the condensate liquid, such as a rotary pump or a reciprocating pump, and is preferably driven by the pump drive. However, in the preferred embodiment, the second pump is a reciprocating pump having a second shaft operably connected to the drive shaft so that the second pump is driven by the pump drive.

In the method form of the invention, the invention is comprised of a method for moving reservoir fluids from an underground reservoir using a wellbore having an inner wall and extending from the surface to an end beneath the surface, wherein the wellbore communicates with the reservoir such that the reservoir fluids enter the wellbore and separate into a liquid phase and a gas phase at a gas pressure, the method comprising the steps of:

(a) intaking the gas phase from the wellbore into a pump drive, contained within the wellbore and powered using the gas pressure of the gas phase in the wellbore, in order to power the pump drive;

(b) powering the pump drive using the gas pressure of the gas phase in the wellbore;

(c) pumping the liquid phase by a first pump, contained within the wellbore and communicating with the liquid phase, wherein the first pump is operably connected to the pump drive such that the first pump is driven by the pump drive; and (d) exhausting the gas phase from the pump drive.

Preferably, the wellbore is comprised of a lower wellbore section and an upper wellbore section and includes a casing, as described for the apparatus form of the invention.

The method preferably further includes the step of controlling the release of the gas phase within the wellbore so that the gas phase is available for the powering step. The controlling step may be performed by any barrier, seal, or other structure capable of performing the necessary function. However, the controlling step is preferably performed by a packer sealingly engaging the inner wall of the wellbore between the upper wellbore section and the lower wellbore section. In such a case, the exhausting step may be comprised of directing the gas phase from the pump drive past the packer either towards the surface or towards a downhole location such as a reservoir.

Further, the exhausting step may be further comprised of the steps of releasing the gas phase from the pump drive into the upper wellbore section and directing the gas phase within the upper wellbore section. In this case, where the upper wellbore section is cased, the exhausting step comprises directing the gas phase within the casing preferably towards the surface.

The pump drive can be any type of drive system that can be powered using the gas pressure of the gas phase in the wellbore, so long as it is compatible with the first pump. Preferably, however, the pump drive defines at least one chamber and includes a reciprocating drive shaft and a moveable piston, as described for the apparatus form of the invention. In this case, the powering step is preferably comprised of alternately first moving the piston using the gas pressure from a first position, adjacent the upper end of the chamber, to a second position, adjacent the lower end of the chamber, and second moving the piston using the gas pressure from the second position to the first position such that the drive shaft reciprocates. Further, the intaking step may be comprised of the steps of alternately first directing a first flow of the gas phase from the lower wellbore section into the upper chamber section of the pump drive and second directing the first flow of the gas phase from the lower wellbore section into the lower chamber section of the pump drive. The first and the second directing steps are performed using a switch, which is preferably a switching valve, in which case the intaking step is further comprised of guiding a second flow of the gas phase from the lower wellbore section to the switching valve for actuation of the switching valve. Alternately, the pump drive may include a turbine having a rotary drive shaft, as described for the apparatus form of the invention.

Further, the first pump may be any type of pump capable of pumping the liquid phase, such as a rotary pump or a reciprocating pump. Preferably, however, the first pump is a reciprocating pump having a first pump shaft operably connected to the drive shaft and the powering step reciprocates the drive shaft which reciprocates the first pump shaft to pump the liquid phase. Alternately, the first pump is a rotary pump having a first pump shaft operably connected to the drive shaft such that the powering step rotates the drive shaft which rotates the first pump shaft to pump the liquid phase.

As well, the method may be further comprised of the step of pumping a condensate liquid, contained in the upper wellbore section, from the upper wellbore section by a second pump. In this case, the second pump is preferably as described for the apparatus form of the invention such that the powering step reciprocates the drive shaft which reciprocates the second pump shaft.

In a preferred embodiment, where the liquid phase is pumped towards the surface and the gas phase is directed towards the surface, the first pump and the pump drive are preferably located at a depth beneath the surface of between about 1,000 and 2,000 meters. As well, the pressure of the gas phase in the lower wellbore section is preferably between about 100 and 250 pounds per square inch. Finally, the gas phase preferably has a flow rate at the surface of between about 5,000 and 10,000 cubic meters per day.

BRIEF DESCRIPTION OF DRAWINGS

Embodiments of the invention will now be described with reference to the accompanying drawings, in which.

BEST MODE OF CARRYING OUT INVENTION

Figure 1:
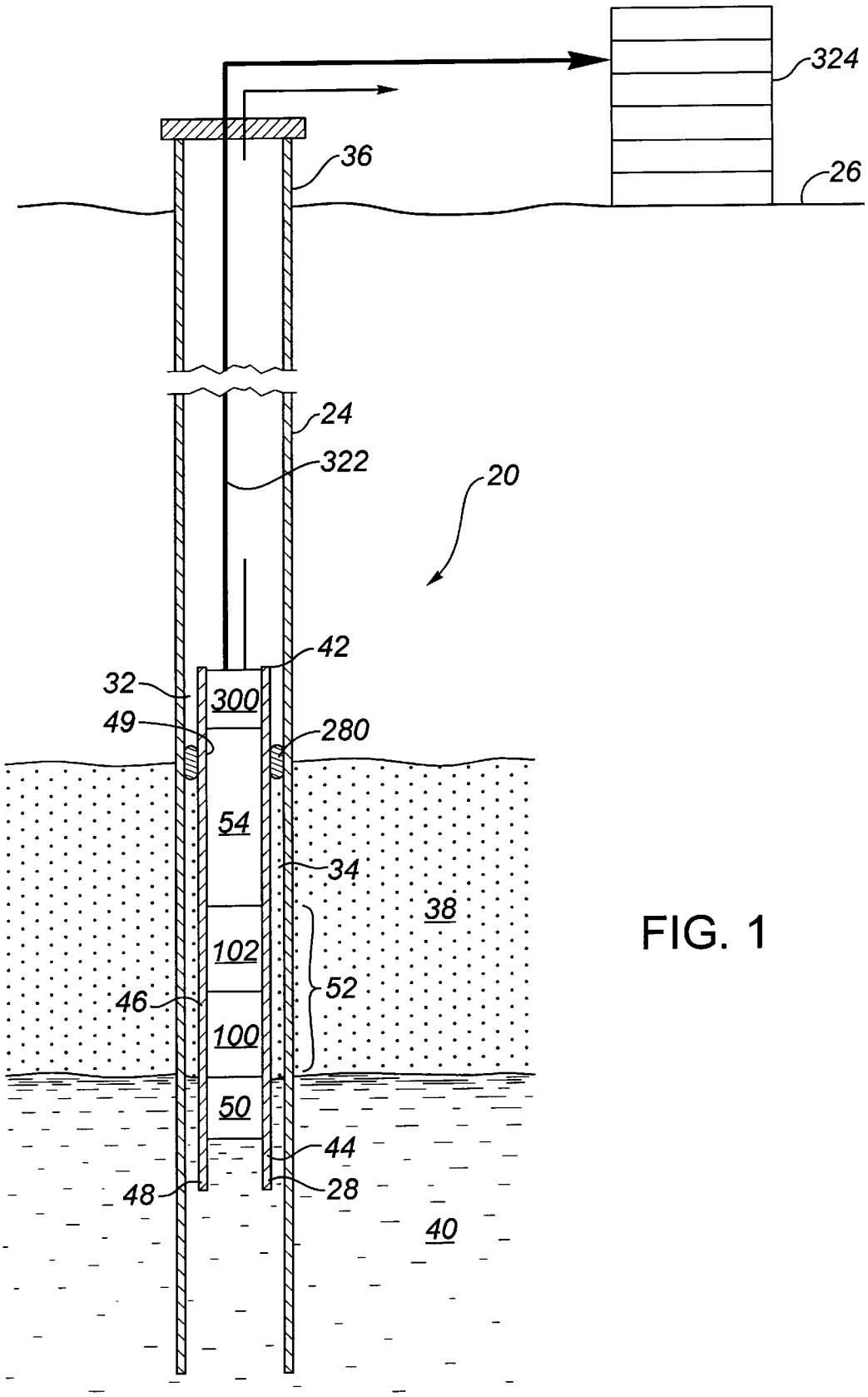
FIG. 1 is a schematic view of the apparatus contained within a wellbore extending from the surface to an end beneath the surface within an underground reservoir.

Referring to FIG. 1, the within invention is directed at an apparatus (20), and a method using the apparatus (20) for moving reservoir fluids from an underground reservoir (22) using a wellbore (24). The wellbore (24) extends from the ground surface (26) to an end (28) beneath the surface (26) and has an inner wall (30). Further, the wellbore (24) communicates with the reservoir (22) so that the reservoir fluids can enter the wellbore (24) by passing from the underground reservoir (22) into the wellbore (24). The wellbore (24) further includes an upper wellbore section

(32) and a lower wellbore section (34). The lower wellbore section (34) is adjacent the end (28) of the wellbore (24) and communicates with the underground reservoir (22). The upper wellbore section (32) extends from the lower wellbore section (34) to the surface (26) and preferably does not communicate with the underground reservoir (22).

The invention is preferably used to produce reservoir fluids from an underground reservoir, so that the liquid phase is preferably pumped towards the surface and the gas phase is preferably directed towards the surface. The invention, may, however be used to move reservoir fluids from an underground reservoir towards an underground or downhole location such as a reservoir, in which case the liquid phase may be pumped and the gas phase may be directed in any direction to facilitate the objectives of the wellbore.

For example, although in the preferred embodiment the liquid phase is pumped generally upwards towards the surface, the liquid phase may also be pumped horizontally or even downwards towards a downhole location. This option is particularly attractive where the pressure of the gas phase is low and the pumping pressure is therefore also low. In circumstances where a second pump is utilized to pump a condensate liquid, similar considerations apply, and the condensate liquid also may be pumped upwards, horizontally or even downwards.

Similarly, although the gas phase is preferably directed generally towards the surface after being exhausted from the pump drive, the gas phase may also be directed horizontally or even downwards towards a downhole location. This option may be attractive where there is insufficient quantity of gas phase being removed from the underground reservoir to justify production of the gas phase to the surface.

In the preferred embodiment, the wellbore (24) includes a casing (36) which lines the inner wall (30) of the wellbore (34) in both the upper and lower wellbore sections (32, 34). When the lower wellbore section (34) is cased, the casing (36) in the lower wellbore section (34) defines a plurality of perforations or holes for communication between the reservoir (22) and the lower wellbore section (34). As a result, the reservoir fluids may pass from the underground reservoir (22) into the wellbore (24) by either passing through the perforations in the casing (36) or passing through the end (28) of the wellbore (24).

The reservoir fluids in the underground reservoir (22) include a gas phase (38) and a liquid phase (40). The gas phase (38) is substantially comprised of at least one gas, which is contained in the underground reservoir (22) at a gas pressure, but may also include an amount of a liquid or a solid carried along with the gas. The gas may be any gaseous substance, however, given that the apparatus (20) is preferably used on a natural gas producing well, the gas is preferably comprised of at least an amount of a combustible hydrocarbon gas, such as methane. The liquid phase (40) is substantially comprised of at least one liquid, but may also include an amount of a gas or a solid. The liquid may be any liquid substance contained in the underground reservoir (22). However, in a natural gas producing well, the liquid is typically primarily water and/or a hydrocarbon, such as oil.

When the reservoir fluids enter the wellbore (24), the fluids naturally separate into the gas phase (38) and the liquid phase (40). The gas phase (38) rises within the lower wellbore section (34) towards the surface (26), while the liquid phase falls towards the end (28) of the wellbore (24). Where separation does not occur naturally, known devices and methods may be employed for separating the fluids into the gas phase (38) and the liquid phase (40) within the wellbore (24).

In operation, the apparatus (20) is contained within the wellbore (24) in communication with the reservoir fluids in the underground reservoir (22). The apparatus (20) is an elongate structure having an upper end (42), a lower end (44), and an outer surface (46). The apparatus (20) has a longitudinal axis which extends from its upper end (42) to its lower end (44). When contained within the wellbore (24), the upper end (42) is nearer the surface (26) than the lower end (44) and the lower end (44) is nearer the end (28) of the wellbore (24) than the upper end (42), as shown in FIG. 1. As well, the longitudinal axis of the apparatus (20) runs substantially parallel to the inner wall (30) of the wellbore (24) such that the apparatus (20) is out of contact with the inner wall (30). Further, in the preferred embodiment, the apparatus (20) includes a conventional tubular liner (48) which extends from the upper end (42) to the lower end (44) of the apparatus (20) and has an inner surface (49). The inner surface (49) of the liner (48) is preferably in close contact with, or abuts against, the outer surface (46) of the apparatus (20).

The apparatus (20) is comprised of a first pump (50) for pumping the liquid phase (40) towards the surface (26). During operation, the first pump (50) is contained within the wellbore (24), preferably in the lower wellbore section (34), in contact with the liquid phase (40). In the preferred embodiment, the first pump (50) is located adjacent the lower end (44) of the apparatus (20) within the tubular liner (48).

The pump drive can be any type of drive system that can be powered using the gas pressure of the gas phase in the wellbore, so long as it is compatible with the first pump (50). In the preferred embodiment, the apparatus (20) is comprised of a pump drive (52) operably connected to the first pump (50) in a manner such that it drives the first pump (50). In operation, the pump drive (52) is also contained within the wellbore (24), preferably in the lower wellbore section (34). The pump drive (52) is preferably located within the liner (48) adjacent the first pump (50) nearer to the surface (26) than the first pump (50). However, the pump drive (44) may be contained within the wellbore (24) in any relationship to the first pump (50) as long as it drives the first pump (50). The pump drive (44) is powered using the gas pressure of the gas phase (38) in the wellbore (24). Thus, as compared to known gas lift systems, the apparatus (20) provides a gas powered downhole first pump (50) which creates a mechanical advantage for producing the liquid phase (40) towards the surface (26).

The apparatus (20) further includes an intake and an exhaust. In operation, the intake communicates with the gas phase (38) in the lower wellbore section (34) and directs the gas phase (38) to the pump drive (52) in order to power the pump drive (52). The exhaust then directs the gas phase (38) from the pump drive (52) towards the surface (26). Thus, the intake and the exhaust permit the gas phase (38) to circulate through the pump drive (52) in order to power it. In the preferred embodiment, the intake and the exhaust are comprised of a valving device (54) which controls and directs the gas phase (38) in order to power the pump drive (52). The valving device (54) is located adjacent the pump drive (52) nearer the surface (26) than the pump drive (52). In other words, the pump drive (52) is preferably located within the liner (48) between the first pump (50) and the valving device (54), however, any other operable relationship may also be used.

Figure 3:
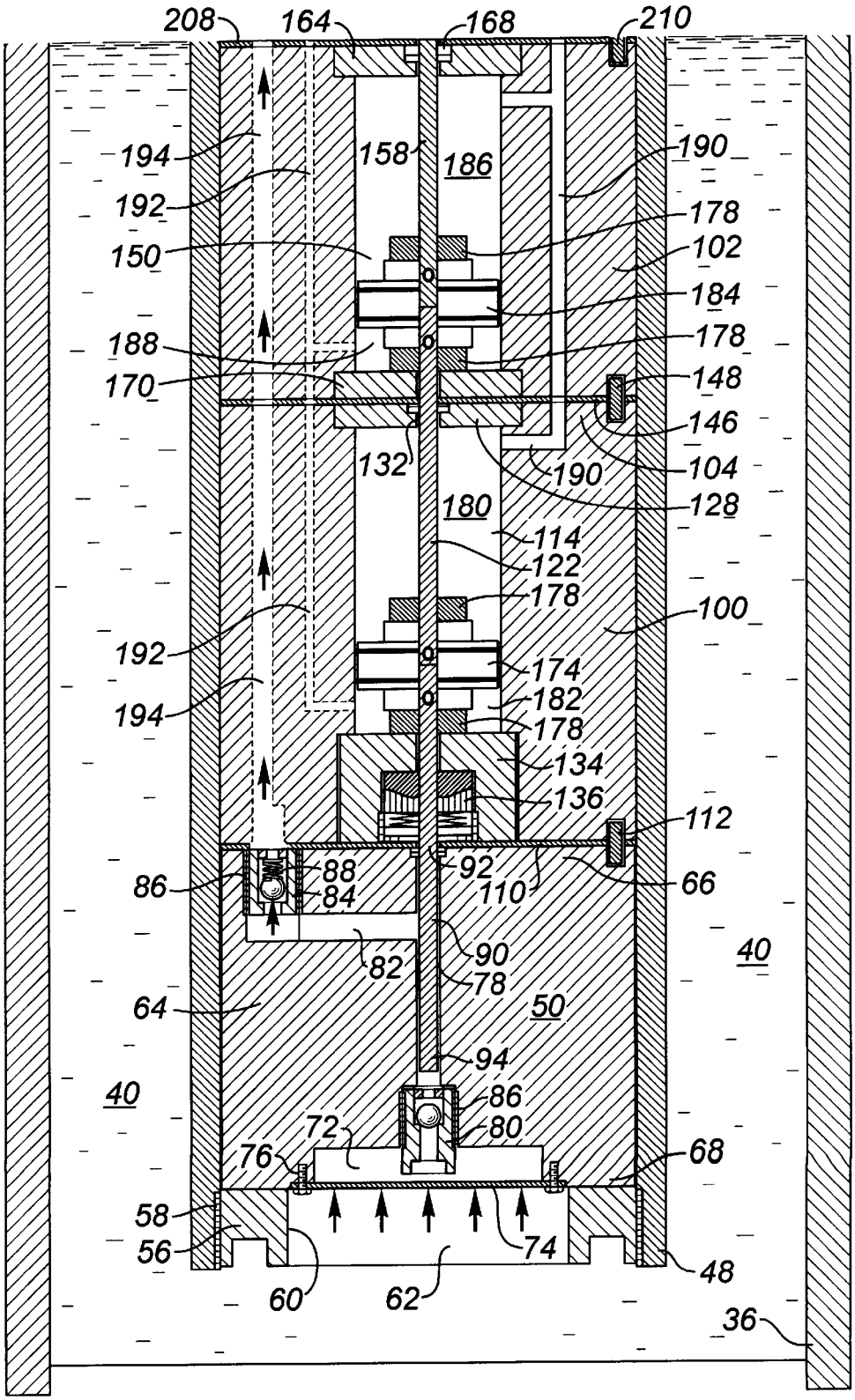
Figure 4:
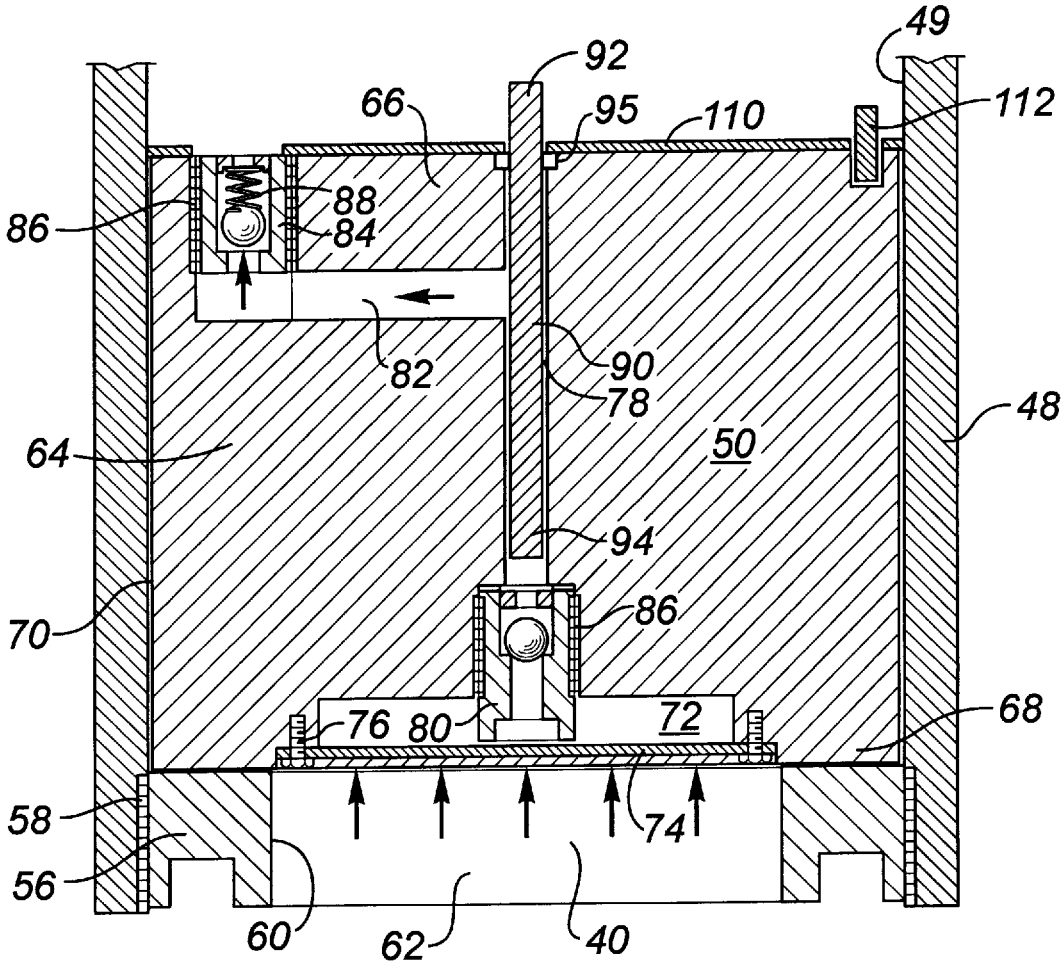
FIG. 4 is a longitudinal sectional view of a first pump of the apparatus.

Referring to FIGS. 3 and 4, the apparatus (20) further includes a bottom flange (56) at the lower end (44) of the apparatus (20). The bottom flange (56) is tubular such that it has an outer surface (58) and an inner surface (60). The outer surface (58) is threadably connected to the inner surface (49) of the liner (48). The inner surface (60) defines a liquid phase inlet (62) for passage of the liquid phase (40) from the wellbore (24) into the apparatus (20), and specifically, into the first pump (50). Therefore, the bottom flange (56) provides a base for the support of the other elements or parts of the apparatus (20), while allowing for the passage of the liquid phase (40) therethrough. Although the preferred embodiment includes a bottom flange (56), any alternate structure capable of maintaining the structural relationship of the parts or elements of the apparatus (20) may be used.

Figure 11:
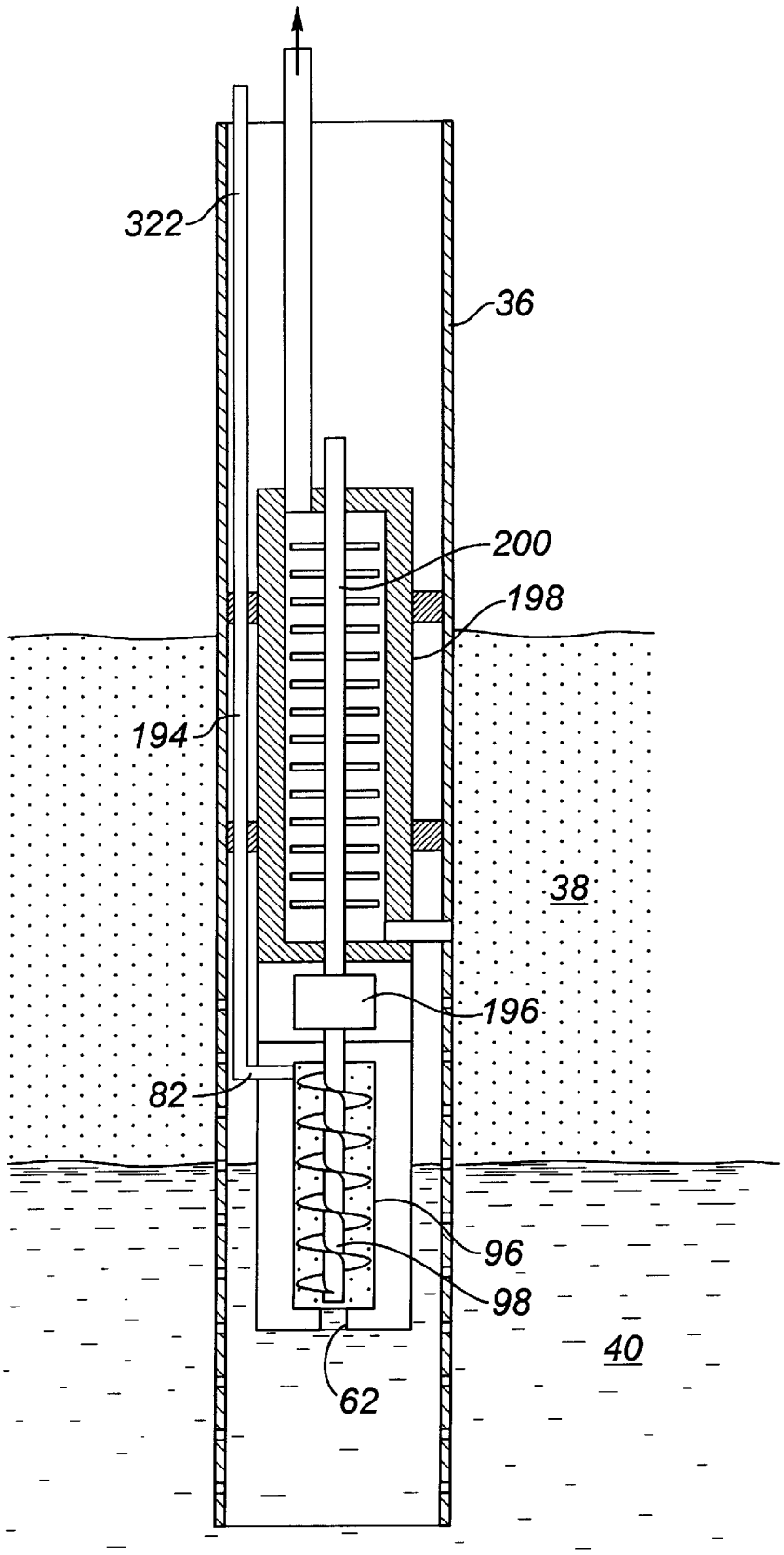
FIG. 11 is a schematic view of an alternate embodiment of the apparatus.

The first pump (50) may be either a rotary pump, as shown in FIG. 11, or a reciprocating pump, as shown in FIGS. 3 and 4. Any type of pump able to operate within the wellbore (24) and capable of pumping the liquid phase (40) towards the surface (26) may be used, so long as the pump is compatible with the pump drive. However, in the preferred embodiment, the first pump (50) is a reciprocating pump.

Referring to FIGS. 3 and 4, the first pump (50) includes a pump body (64) having an upper end (66), a lower end (68) and an outer surface (70). The outer surface (70) of the pump body (64) makes up a portion of the outer surface (46) of the apparatus (20). The lower end (68) of the pump body (64) abuts against the bottom flange (56). Further, the pump body (64) defines a liquid phase collection area (72) at its lower end (68) adjacent to, and in communication with, the liquid phase inlet (62) so that the liquid phase (40) can pass from the wellbore (24), through the liquid phase inlet (62) in the bottom flange (56), and into the liquid phase collection area (72). A filter screen (74) is preferably mounted on or within the lower end (68) of the pump body (64), by screws (74), between the liquid phase inlet (62) and the liquid phase collection area (72). As a result, the liquid phase (40) contained within the liquid phase collection area (72) is filtered. Preferably the filter screen is a conventional wire screen, however, any suitable filter may be used.

The pump body (64) also defines a bore (78) which extends from the upper end (66) of the pump body (64) towards the liquid phase collection area (72). A lower valve (80), preferably a check valve, is located, and permits communication, between the bore (78) and the liquid phase collection area (72). The lower valve (80) permits the flow of the liquid phase (40) from the liquid phase collection area (72) into the bore (78), but not out of the bore (78) back into the liquid phase collection area (72). The lower valve (80) is mounted within the pump body (64) by a threaded connection (86) and is preferably any standard type one-way check valve.

Further, the pump body (64) defines a first liquid conduit (82) which extends from the bore (78) towards the upper end (66) of the pump body (64). An upper valve (84), preferably a check valve, is located, and allows communication, between the first liquid conduit (82) and the upper end (66) of the pump body (64). The liquid phase (48) in the bore (78) passes from the bore (78) into the first liquid conduit (82), through the upper valve (84) and out the upper end (66) of the pump body (64). The upper valve (84) is mounted within the pump body (64) by a threaded connection (86) and is preferably any standard type one-way check valve. The upper valve (84) is biased by spring (88) to permit the flow of the liquid phase (48) out of the first liquid conduit (82) but not back into it.

The first pump (50) is further comprised of a first pump shaft (90), having an upper end (92) and a lower end (94), located within the bore (78) of the pump body (64). The first pump shaft (90) is longitudinally moveable within the bore (78) such that the first pump shaft (90) may reciprocate within the bore (78) to alternately move the lower end (94) away from and towards the lower valve (80). Reciprocation of the first pump shaft (90) in the bore (78) is directed and guided by a pump shaft guide (95).

The first pump shaft (90) is operably connected to the pump drive (52) such that the pump drive (52) causes the first pump shaft (90) to reciprocate within the bore (78). Movement of the lower end (94) of the first pump shaft (90) upwards, away from the lower valve (80), initiates a suction or negative pressure in the bore (78) which opens the lower valve (80) and draws the liquid phase (40) from the liquid phase collection area (72) through the lower valve (80) and into the bore (78). Movement of the lower end (94) of the first pump shaft (90) downwards, towards the lower valve (80), closes the lower valve (80) and causes the liquid phase (40) in the bore (78) to discharge from the bore (78) into the first liquid conduit (82), which further causes the upper valve (84) to open and allow the passage of the liquid phase (40) therethrough.

Referring to FIG. 11, where the first pump (50) is a rotary pump, the pump body (64) described for the preferred embodiment is replaced by a conventional progressive cavity pump (96) having a rotating first pump shaft (98). In this case, rotation of the first pump shaft (98) by the pump drive draws the liquid phase (40) from the wellbore (24) into the progressive cavity pump (96) and subsequently expels the liquid phase (40) out of the progressive cavity pump (96) through the first liquid conduit (82).

Figure 5:
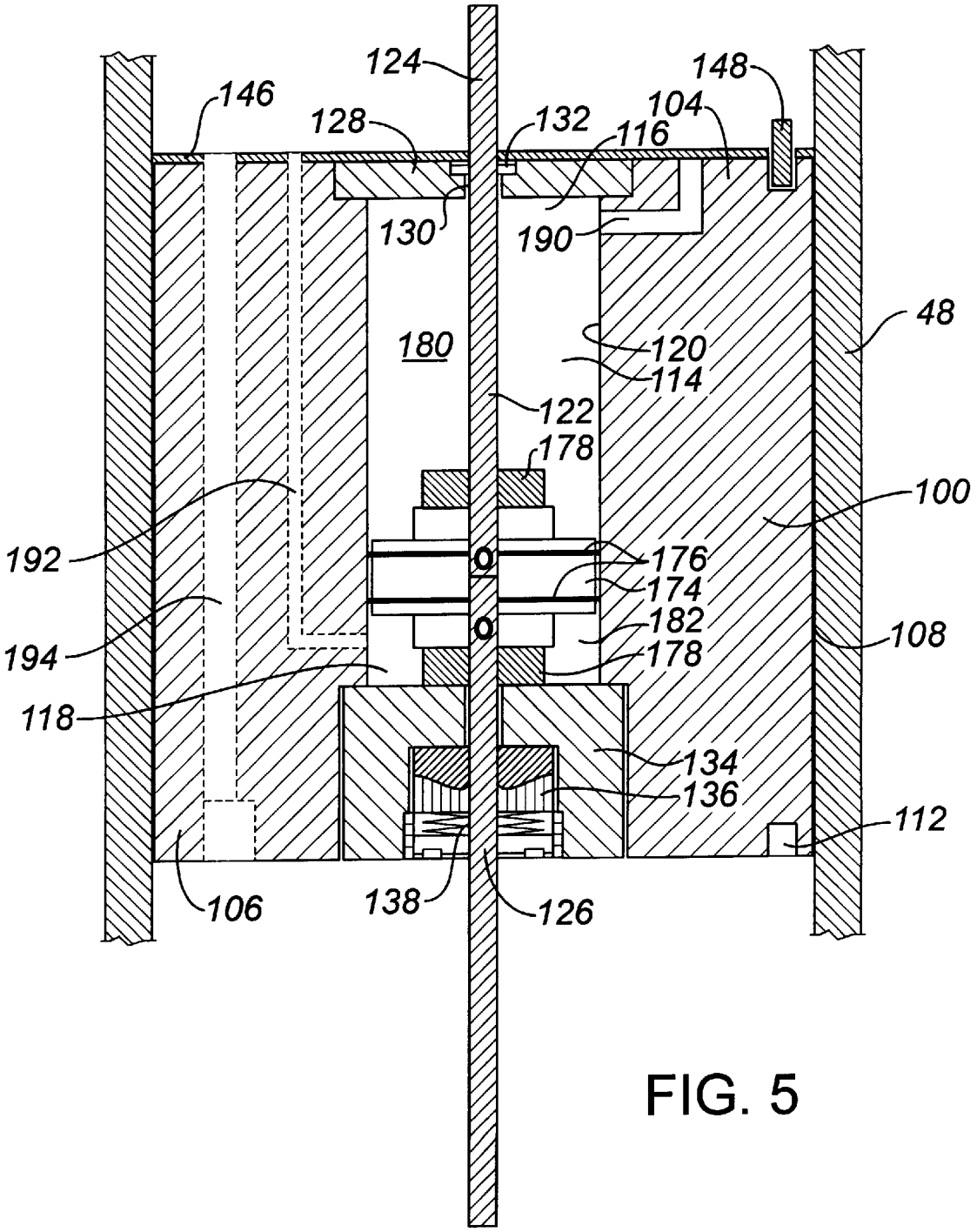
FIG. 5 is a longitudinal sectional view of a primary driver of the apparatus.
Figure 6:
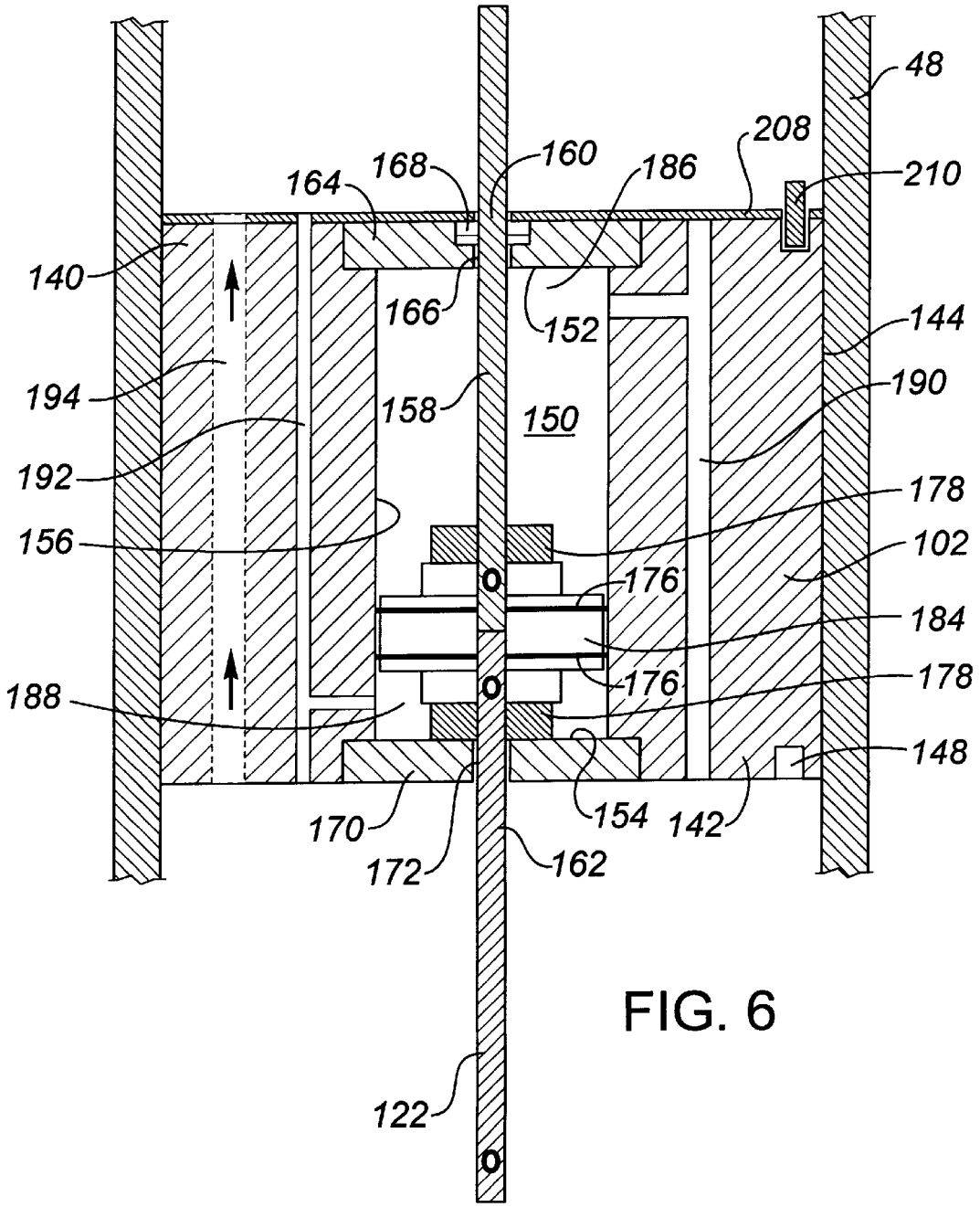
FIG. 6 is a longitudinal sectional view of a supplementary driver of the apparatus.

Referring to FIGS. 3, 5 and 6, in the preferred embodiment, the pump drive (52) is comprised of a primary driver (100). In addition, depending upon the gas pressure, volume and velocity of the gas phase (38) and the type and amount of the liquid phase (40), the pump drive (52) may include one or more supplementary drivers, as needed. In the preferred embodiment, the pump drive (52) includes one supplementary driver (102).

Referring to FIGS. 3 and 5, the primary driver (100) has an upper end (104), a lower end (106) and an outer surface (108). The outer surface (108) of the primary driver (100) makes up a portion of the outer surface (46) of the apparatus (20). The lower end (106) of the primary driver (100) preferably abuts against and is aligned with the upper end (66) of the pump body (64). However, any other operable relationship of the parts is permissible. A conventional gasket (110) is preferably positioned between the abutting surfaces (106, 66). Further, the alignment of the primary driver (100) and the pump body (64) is maintained by a locating pin (112) extending between the abutting surfaces (106, 66).

The primary driver (100) defines a primary chamber (114) which extends longitudinally between the upper end (104) and the lower end (106) of the primary driver (100). Further, the primary driver (100) has an upper end (116), a lower end (118) and an inner side surface (120), and includes a primary drive shaft (122) having an upper end (124) and a lower end (126). The upper end (124) of the primary drive shaft (122) passes through the upper end (116) of the primary chamber (114) and the lower end (126) of the primary drive shaft (122) passes through the lower end (118) of the primary chamber (114). The primary drive shaft (122) is operably connected to the first pump (50) for driving the first pump (50). Specifically, in the preferred embodiment, the lower end (126) of the primary drive shaft (122) is operably connected to the upper end (92) of the first pump shaft (90). As a result, in the preferred embodiment, reciprocation of the primary drive shaft (122) drives the first pump (50) by reciprocating the first pump shaft (90).

The upper end (116) of the primary chamber (114) is formed by a holding plate (128) located at the upper end (104) of the primary driver (100). The holding plate (128) defines an aperture (130) for the passage of the upper end (124) of the primary drive shaft (122) therethrough. Reciprocation of the primary drive shaft (122) in the aperture (130) is directed and guided by a conventional drive shaft guide (132).

The lower end (118) of the primary chamber (114) is formed by a conventional seal (134) located at the lower end (106) of the primary driver (100). The seal (134) includes packing (136) which defines an aperture (138) for the passage of the lower end (126) of the primary drive shaft (122) therethrough. The packing (136) is intended to form a seal against the primary drive shaft (122) in order to inhibit the passage of the liquid phase (40) out of the first pump (50) into the primary driver (100).

Referring to FIGS. 3 and 6, the supplementary driver (102) has an upper end (140), a lower end (142) and an outer surface (144). The outer surface (144) of the supplementary driver (102) makes up a portion of the outer surface (46) of the apparatus (20). The lower end (142) of the supplementary driver (102) preferably abuts against and is aligned with the upper end (104) of the primary driver (100), although any other operable arrangement may be used. A conventional gasket (146) is preferably positioned between the abutting surfaces (104, 142) and the alignment of the abutting surfaces (104, 142) is maintained by a locating pin (148) extending therebetween.

The supplementary driver (102) defines a supplementary chamber (150) which extends longitudinally between the upper end (140) and the lower (142) of the supplementary driver (102). Further, the supplementary driver (102) has an upper end (152), a lower end (154) and an inner side surface (156), and includes a supplementary drive shaft (158) having an upper end (160) and a lower end (162). The upper end (160) and the lower end (162) of the supplementary drive shaft (158) pass through the upper end (152) and the lower end (154) of the supplementary chamber (150) respectively. The supplementary drive shaft (158) is operably connected to the primary drive shaft (122). Specifically, the lower end (162) of the supplementary drive shaft (158) is connected to the upper end (124) of the primary drive shaft (122). As a result, the primary drive shaft (122) and the supplementary drive shaft (158) reciprocate concurrently.

The upper end (152) of the supplementary chamber (150) is formed by a holding plate (164) located at the upper end (140) of the supplementary driver (102). The holding plate (164) defines an aperture (166) for the passage of the upper end (160) of the supplementary drive shaft (158) therethrough. Reciprocation of the supplementary drive shaft (158) in the aperture (166) is directed and guided by a conventional drive shaft guide (168).

The lower end (154) of the supplementary chamber (150) is formed by a conventional retaining plate (170) located at the lower end (142) of the supplementary driver (102). The retaining plate (170) defines an aperture (172) for the passage of the lower end (162) of the supplementary drive shaft (158) therethrough.

A moveable piston is located within each of the primary chamber (114) and the supplementary chamber (150). A primary piston (174) is fixedly mounted on the primary drive shaft (122) and sealingly engages the inner side surface (120) of the primary chamber (114) by at least one conventional 0-ring (176). In addition, each side of the primary piston (174) includes a shock absorber (178), being any conventional shock absorber, preferably a rubber pad. The shock absorber (178) absorbs or cushions the forces as the primary piston (174) reciprocates within the primary chamber (114) and comes into contact with either the upper end (116) or the lower end (118) of the primary chamber (114). The primary piston (174) divides the primary chamber (114) into an upper chamber section (180) and a lower chamber section (182) and reciprocates within the primary chamber (114), which results in reciprocation of the connected primary drive shaft (122).

A supplementary piston (184) is fixedly mounted on the supplementary drive shaft (158) and sealingly engages the inner side surface (156) of the supplementary chamber (150) by at least one conventional 0-ring (176). In addition, each side of the supplementary piston (184) also includes a conventional shock absorber (178), preferably a rubber pad (178), for absorbing or cushioning the forces as the supplementary piston (184) reciprocates within the supplementary chamber (150) and comes into contact with either the upper end (152) or the lower end (154) of the supplementary chamber (150). The supplementary piston (184) divides the supplementary chamber (150) into an upper chamber section (186) and a lower chamber section (188) and reciprocates within the supplementary chamber (150), which results in reciprocation of the connected supplementary drive shaft (158).

Figure 8:
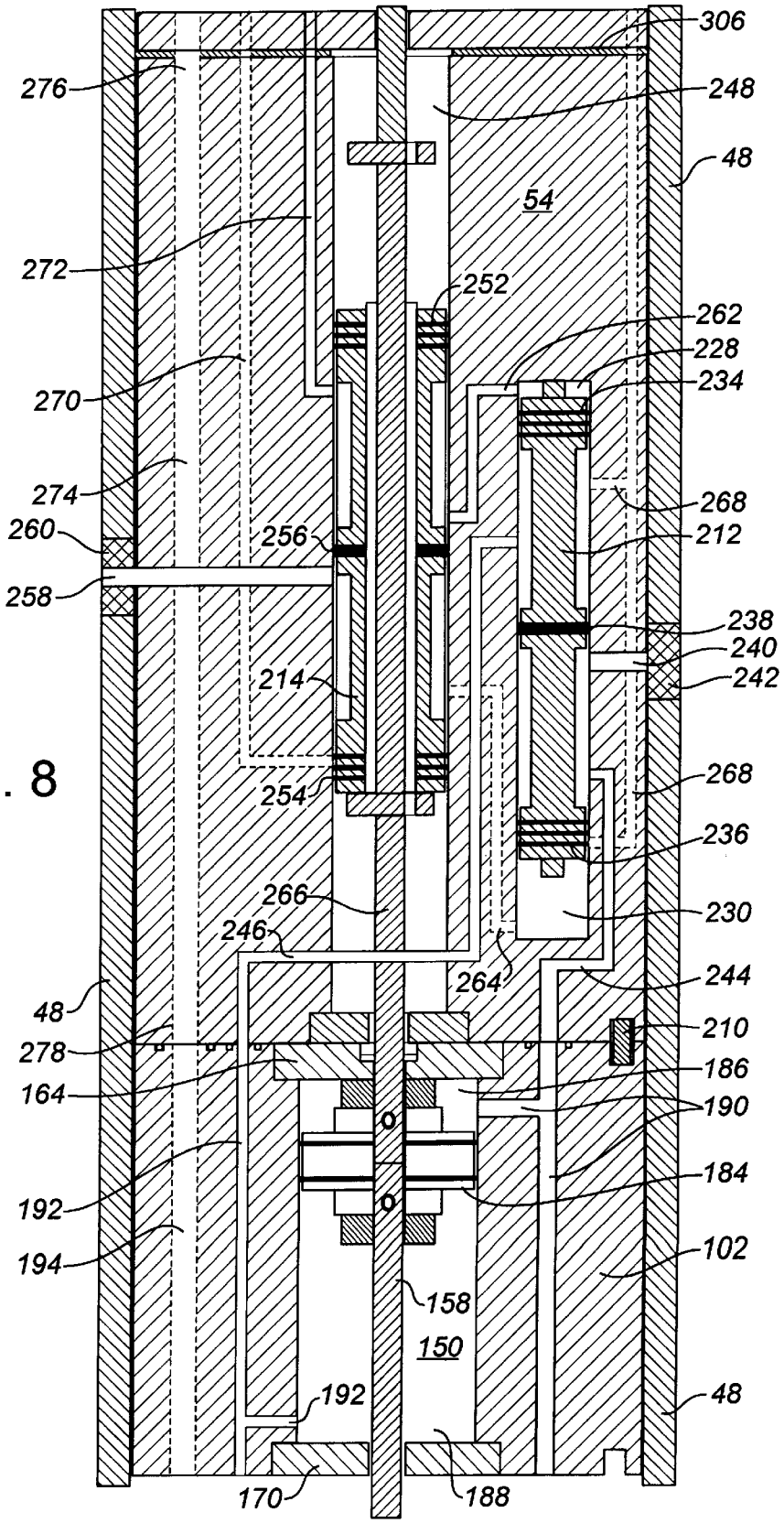
FIG. 8 is a longitudinal section of the supplementary driver and the valving device as shown in FIGS. 6 and 7, showing a first position of a supplementary piston in the supplementary driver.
Figure 9:
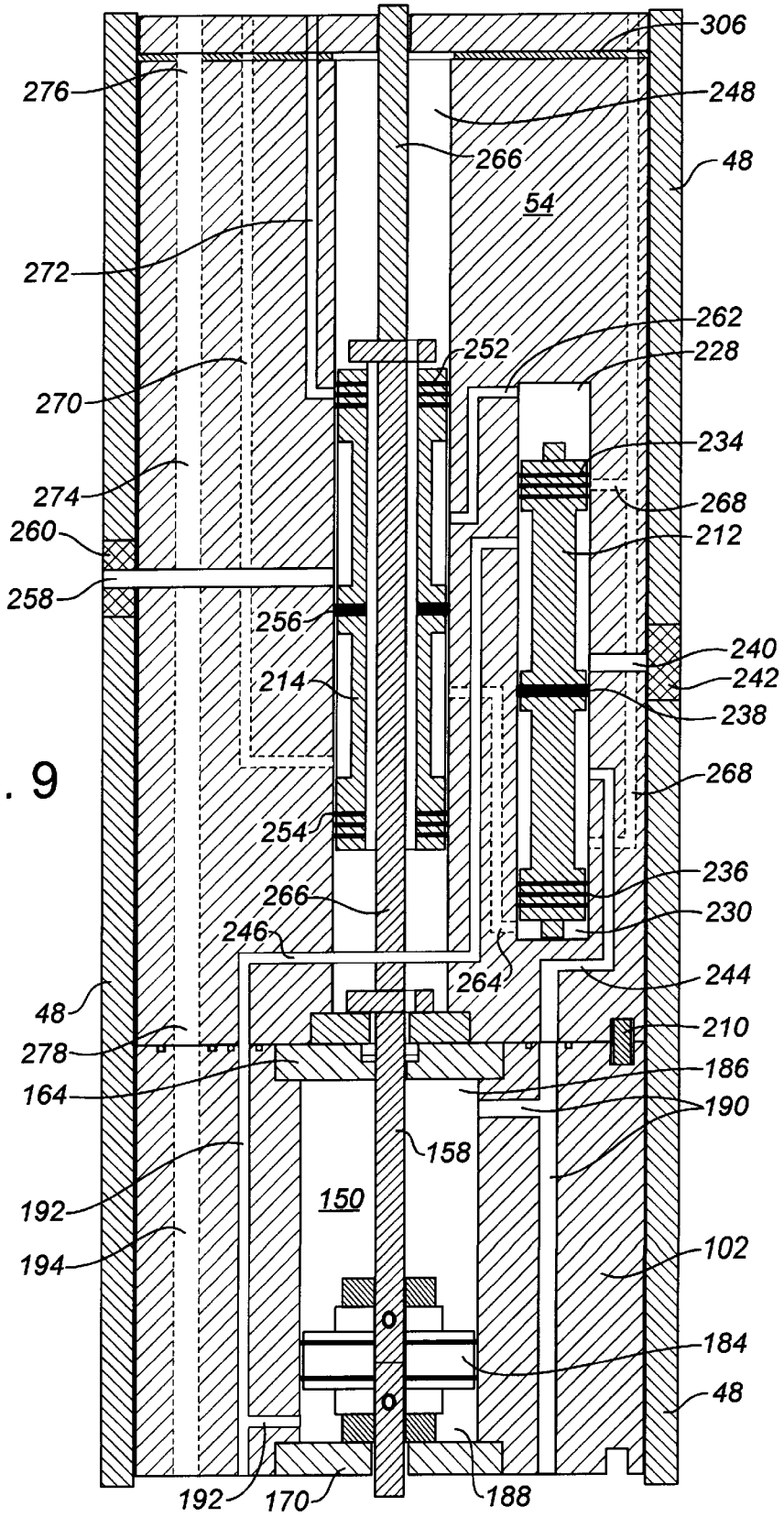
FIG. 9 is a longitudinal section of the supplementary driver and the valving device as shown in FIGS. 6 and 7, showing a second position of the supplementary piston in the supplementary driver.

The pump drive (52) is further comprised of first means for concurrently moving each of the pistons (174, 184) using the gas pressure of the gas phase (38) from a first position, adjacent the upper ends (116, 152) of the respective chambers (114, 150), to a second position, adjacent the lower ends (118, 154) of the respective chambers (114, 150). Thus, in the first position, the primary piston (174) is adjacent the upper end (116) of the primary chamber (114) such that the shock absorber (178) comes into contact therewith and the supplementary piston (174) is adjacent the upper end (152) of the supplementary chamber (150) such that the shock absorber (178) comes in contact therewith, as shown in FIG. 8. Conversely, in the second position, the primary piston (174) is adjacent the lower end (118) of the primary chamber (114) such that the shock absorber (178) comes into contact therewith and the supplementary piston (184) is adjacent the lower end (154) of the supplementary chamber (150) such that the shock absorber (178) comes into contact therewith, as shown in FIG. 9. As well, the pump drive (52) is comprised of second means for concurrently moving each of the pistons (174, 184) using the gas pressure from the second position to the first position.

Any first and second moving means capable of performing the necessary function, as described above, may be used. However, in the preferred embodiment, the first moving means is comprised of a first gas conduit (190) which directs the gas phase (30) into both of the upper chamber sections (180, 186) of the primary and supplementary drivers (114, 150). Specifically, the first gas conduit (190) extends from the upper end (140) of the supplementary driver (102) to both the upper chamber section (186) of the supplementary chamber (150) and the upper chamber section (180) of the primary chamber (114). As the gas phase (38) passes from the first gas conduit (190) into the upper chamber sections (180, 186), the gas pressure causes the pistons (174, 184) to concurrently move towards the second position.

As well, in the preferred embodiment, the second moving means is comprised of a second gas conduit (192) which directs the gas phase (38) into both of the lower chamber sections (182, 188) of the primary and supplementary drivers (114, 150). Specifically, the second gas conduit (192) extends from the upper end (140) of the supplementary driver (102) to both the lower chamber section (188) of the supplementary chamber(150) and the lower chamber section (182) of the primary chamber (114). As the gas phase (38) passes from the second gas conduit (192) into the lower chamber sections (182, 188), the gas pressure causes the pistons (174, 184) to concurrently move towards the first position.

Finally, in order to cause the pistons (174, 184) to alternately move between the first position and the second position, the intake of the apparatus (20), or the valving device (54), alternately directs the gas phase (38) from the lower wellbore section (34) into the first gas conduit (190) and the second gas conduit (192). As a result, the primary and supplementary drive shafts (122, 158) are caused to concurrently reciprocate, which results in the reciprocation of the first pump shaft (90) in order to pump the liquid phase (40) towards the surface (26).

In order to pump the liquid phase (40) from the first pump (50) towards the surface (26), the primary and supplementary drivers (100, 102) define a second liquid conduit (194). Specifically, the second liquid conduit (194) extends through the primary and supplementary drivers (100, 102) from the lower end (106) of the primary driver (100) to the upper end (140) of the supplementary driver (102). At the lower end (106) of the primary driver (100), the second liquid conduit (194) is adjacent the upper valve (84) of the first pump (50) so that the liquid phase (40) may pass from the first liquid conduit (82) into the second liquid conduit (194).

In the alternate embodiment of the apparatus as shown in FIG. 11, the pump drive is comprised of a gear box (196). Any conventional gear box may be used for this purpose. The gear box (196) is operably connected to the rotating first pump shaft (98) of the progressive cavity pump (96) in order that the gear box (196) drives the progressive cavity pump (96). Further, the pump drive is comprised of a conventional turbine (198) which includes a turbine drive shaft (200) operably connected to the gear box (196). The position of the turbine (198) in the wellbore (24) may be maintained by one or more guides. In operation, the intake of the apparatus (20) directs the gas phase (38) from the lower wellbore section (34) to the turbine (198) in order to power the turbine (198). Specifically, the gas pressure causes the turbine (198) to rotate, which acts on the gear box (196) to drive the progressive cavity pump (96). Once the gas phase (38) has circulated through the turbine (198), the exhaust of the apparatus (20) directs the gas phase (38) from the turbine (198) towards the surface (26) either through the upper wellbore section (32) or through a gas line extending to the surface. Operation of the progressive cavity pump (96) pumps the liquid phase (40) through the progressive cavity pump (96) into the first liquid conduit (82) and into the second liquid conduit (194) which is associated with the turbine (198).

As indicated above, the intake and the exhaust are comprised, at least in part, by the valving device (54). Referring to FIGS. 2 and 7–9, the valving device (54) has an upper end (202), a lower end (204) and an outer surface (206). The outer surface (206) makes up a portion of the outer surface (46) of the apparatus (20). The lower end (204) of the valving device (54) preferably abuts against and is aligned with the upper end (140) of the supplementary driver (102), although any other operable arrangement may be used. A conventional gasket (208) is preferably positioned between the abutting surfaces (140, 204), and the alignment of the abutting surfaces (140, 204) is maintained by a locating pin (210) extending therebetween.

The intake of the apparatus (20) is comprised of the valving device (54), which includes a switch. The switch alternately directs the gas phase (38) from the lower wellbore section (34) into the first gas conduit (190) and the second gas conduit (192). In the preferred embodiment, the switch is comprised of a switching valve (212) and a main valve (214). The switching valve (212) acts to alternately direct a first flow (216) of the gas phase (38) from the wellbore (24) into the first and second gas conduits (190, 192). The main valve (214) acts to guide a second flow (218) of the gas phase (38) from the wellbore (24) to the switching valve (212) for actuation of the switching valve (212).

Preferably, the valving device (54) defines a cavity (220) which contains the switching valve (212). The cavity (220) has an upper end (222), a lower end (224) and an inner surface (226). The switching valve (212) sealingly engages the inner side surface (226) to divide the cavity (220) into an upper cavity section (228) and a lower cavity section (230). The upper cavity section (228) is adjacent the upper end (222) of the cavity (220), while the lower cavity section (230) is adjacent the lower end (224) of the cavity (220). The switching valve (212) is moveable within the cavity (220) between a first state, as shown in FIG. 8, and a second state, as shown in FIG. 9. In the first state, the switching valve (112) is in contact with the upper end (222) of the cavity (220) and the first flow (216) of the gas phase (38) is directed by the switching valve (212) into the first gas conduit (190). In the second state, the switching valve (212) is in contact with the lower end (224) of the cavity (220) and the first flow (216) is directed by the switching valve (212) into the second gas conduit (192). The main valve (214) alternately directs the second flow (218) of the gas phase (38) to the upper cavity section (228) and the lower cavity section (230) so that the gas pressure of the second flow (218) in the cavity sections (228, 230) moves the switching valve (212) between the first and second states.

To perform its function, in the preferred embodiment, the switching valve (212) sealingly engages the inner side surface (226) of the cavity (220) at three points of abutment. At least one conventional O-ring (232) is present at each of the points of abutment for sealing the switching valve (212) to the inner side surface (226) of the cavity (220). However, any other sealing means may be used. A first point of abutment (234) is located at the end of the switching valve (212) nearest to the upper end (222) of the cavity (220). A second point of abutment (236) is located at the end of the switching valve (212) nearest the lower end (224) of the cavity (220). A third point of abutment (238) is located about midway between the first and second points of abutment (234, 236).

In operation, the first flow (216) of the gas phase (38) passes from the lower wellbore section (34) through a switching valve inlet (240) into the cavity (220). A conventional gas filter (242) is preferably located in the switching valve inlet (240) so that all of the first flow (216) entering the cavity (220) is filtered. When the switching valve (212) is in the first state, the first flow (216) enters the cavity (220) between the second and third points of abutment (236, 238). The first flow (216) is then directed out of the cavity (220) into a first switching valve outlet (244). The first switching valve outlet (244) extends from the space between the second and third points of abutment (236, 238) to the lower end (204) of the valving device (54) at a location adjacent to the first gas conduit (190). As a result, the first flow (216)

passes from the wellbore (24) through the switching valve (212) into the first switching valve outlet (244) and the first gas conduit (190). When the switching valve (212) is in the second state, the first flow (216) of the gas phase (38) passes through the switching valve inlet (24) into the cavity (220) in a space between the first and third points of abutment (234, 238). The first flow (216) is then directed out of the space between the first and third points of abutment (234, 238) into a second switching valve outlet (246). The second switching valve outlet (246) extends from the space in the cavity (220) between the first and third points of abutment (234, 238) to the lower end (204) of the valving device (54) at a location adjacent the second gas conduit (192). As a result, the first flow (216) passes from the wellbore (24) through the switching valve (212) to the second switching valve outlet (246) and the second gas conduit (192).

The valving device (54) is tubular such that it defines a bore (248) therethrough extending from its upper end (202) to its lower end (204) and having an inner wall (249). In the preferred embodiment, the main valve (214) is contained within the bore (248) and is moveable therein between a first position, as shown in FIG. 8, and a second position, as shown in FIG. 9. To perform its function, the main valve (214) preferably sealingly engages the inner wall (249) of the bore (248) at three points of abutment. At least one conventional O-ring (250) is present at each of the points of abutment for sealing the main valve (214) to the inner wall (249) of the bore (248). However, any other sealing means may be used. A first point of abutment (252) is located at the end of the main valve (214) nearest the upper end (202) of the valving device (54). A second point of abutment (254) is located at the end of the main valve (214) nearest the lower end (204) of the valving device (54). A third point of abutment (256) is located about midway between the first and second points of abutment (252, 254).

In operation, the first and second positions of the main valve (214) are defined by the specific function performed by the main valve (214) in the respective positions. As indicated, the main valve (214) directs the second flow (218) of the gas phase (38). Specifically, the second flow (218) is directed from the lower wellbore section (34) through a main valve inlet (258) into the bore (248). A conventional gas filter (260) is located in the main valve inlet (258) in order that the second flow (218) entering the main valve (214) is filtered. If the second flow (218) enters the bore (248) into the main valve (214) at a space between the first and third points of abutment (252, 256), then the main valve (214) is in the first position. The second flow (218) is then directed from the space into a first main valve outlet (262). The first main valve outlet (262) extends from the space between the first and third points of abutment (252, 256) to the upper cavity section (228) of the cavity (220). The gas pressure of the second flow (218) then causes the switching valve (212) to move towards the second position.

If the second flow enters the bore (248) into the main valve (214) at a space between the second and third points of abutment (254, 256), then the main valve (214) is in the second position. The second flow (218) is then directed from the space into a second main valve outlet (264). The second main valve outlet (264) extends from the space between the second and third points of abutment (254, 256) to the lower cavity section (230) of the cavity (220). The gas pressure of the second flow (218) then causes the switching valve (212) to move towards the first position.

The valving device (54) includes a valve drive shaft (266). The main valve (214) is movably mounted about the valve drive shaft (216) such that the valve drive shaft (266) extends through the main valve (214) from the lower end (204) of the valving device (54) to the upper end (202) of the valving device (54). Further, the valve drive shaft (266) is operably connected to the supplementary drive shaft (158) in a manner such that reciprocation of the supplementary drive shaft (158) causes reciprocation of the valve drive shaft (266). Reciprocation of the valve drive shaft (266) causes the main valve (214) to move between its first and second positions. In the preferred embodiment, the main valve (214) is caused to move towards either the first or second positions only as the valve drive shaft (266) nears the end of its travel. In other words, the main valve (214) is caused to move into its first position only as the valve drive shaft (266) nears the end of its upward travel towards the surface (266). Alternately, the main valve (216) is caused to move to its second position only as the valve drive shaft (266) nears the end of its travel in a downward direction toward the end (28) of the wellbore (24). Further, the main valve (216) is preferably designed to minimize or avoid the time during which the main valve (214) is in a position in its travel between the first and second positions in which the second flow (218) from the main valve inlet (258) is permitted to simultaneously enter both the space between the first and third points of abutment (252, 256) and the space between the second and third points of abutment (254, 256).

The exhaust of the apparatus (20), and specifically the exhaust of both the first flow (216) and the second flow (218) of the gas phase (38), is also comprised of the valving device (54). As the primary piston (174) and the supplementary piston (184) move from their first position towards their second position, the first flow (216) in the lower chamber sections (182, 188) of the primary and supplementary chambers (114, 150) is forced out of the lower chamber sections (182, 188) into the second gas conduit (192) and subsequently into the second switching valve outlet (246). The first flow (216) then enters the space between the first and third points of abutment (234, 238) of the switching valve (212). From this space, the first flow (216) is directed into a first exhaust conduit (268) and towards the surface.

As the primary and supplementary pistons (174, 184) move from their second position towards their first position, the first flow (216) in the upper chamber sections (180, 186) of the primary and supplementary chambers (114, 150) is forced out of the upper chamber sections (180, 186) into the first gas conduit (190) and subsequently into the first switching valve outlet (244). The first flow (216) then enters the space between the second and third points of abutment (236, 238) of the switching valve (212). From this space, the first flow (216) is also directed into the first exhaust conduit (268) and towards the surface (26). The first exhaust conduit (268) may be comprised of one or more separate or connected conduits which extend from the spaces between the first and third points of abutment (234, 238) and the second and third points of abutment (236, 238) of the switching valve (212) to the upper end (202) of the valving device (54). Once in the first exhaust conduit (268), the first flow (216) is directed towards the surface.

As the switching valve (212) moves from its first state towards its second state, the second flow (218) in the lower cavity section (230) of the cavity (220) is forced out of the lower cavity section (230) into the second main valve outlet (264). The second flow (218) then enters the space between the second and third points of abutment (254, 256) of the main valve (214). At the time of entering this space, the main valve (214) is in its first position. From the space between the second and third points of abutment (254, 256) of the main valve (214), the second flow (218) is then directed into a second exhaust conduit (270) and directed towards the surface (26).

As the switching valve (212) moves from its second position towards its first position, the second flow (218) in the upper cavity section (228) of the cavity (220) is forced out of the upper cavity section (228) into the first main valve outlet (262). The second flow (218) then enters the space between the first and third points of abutment (252, 256) of the main valve (214). At this time, the main valve (214) is in the second position. The second flow (218) is then directed from the space between the first and third points of abutment (252, 256) of the main valve (214) into a third exhaust conduit (272) and towards the surface. The second exhaust conduit (270) and the third exhaust conduit (272) may be combined into a single conduit or may be comprised of one or more further conduits. Each of these conduits (270, 272) extends from the main valve (214) to the upper end (202) of the valving device (54).

The valving device (54) is further comprised of a third liquid conduit (274) having an upper end (276) and a lower end (278). The third liquid conduit (274) extends from its lower end (278), which is aligned to be adjacent to the second liquid conduit (194), to its upper end (26), at the upper end (202) of the valving device (54). As a result, the liquid phase (40) in the second liquid conduit (194) is directed into the third liquid conduit (274) and towards the surface (26).

Figure 2:
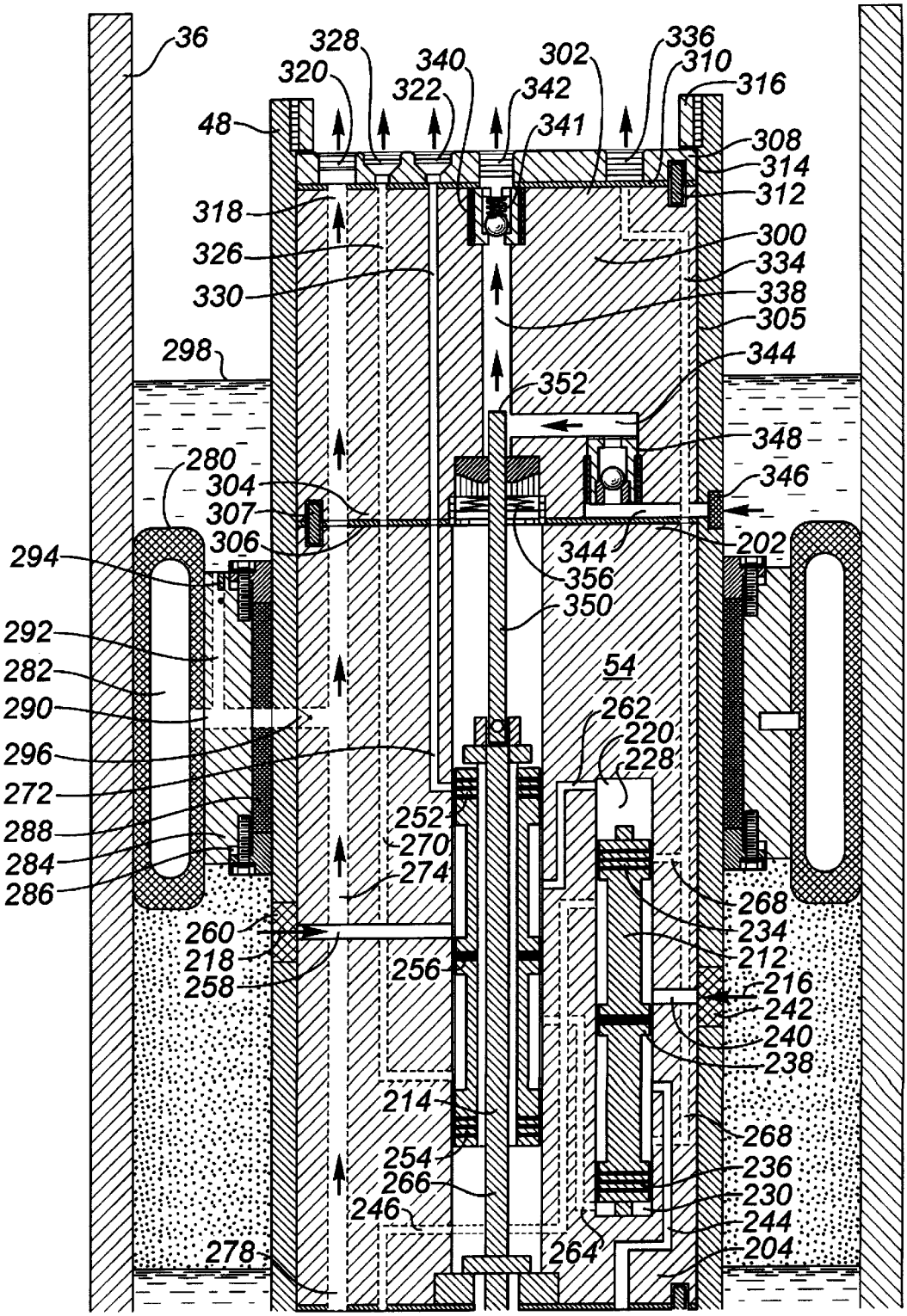
FIGS. 2 and 3 together constitute a more detailed longitudinal section of the apparatus shown in FIG. 1, FIG. 3 being a lower continuation of FIG. 2.

Referring to FIG. 2, the preferred embodiment of the apparatus (22) is further comprised of means, associated with the wellbore (24), for controlling the release of the gas phase (38) from the wellbore (24) so that the gas phase (38) is available to power the pump drive (52). Any structure capable of maintaining a substantial portion of the gas phase (38) in the wellbore (24), preferably in the lower wellbore section (34), may be used. However, in the preferred embodiment, the controlling means are comprised of an inflatable bladder which is preferably positioned in the wellbore (24) between the upper wellbore section (32) and the lower wellbore section (34). Specifically, the inflatable bladder is a packer (280) capable of being inflated and deflated by controls at the surface (26). The packer (280) seals the space between the liner (48) of the apparatus (20) and the casing (36) of the wellbore (24). The packer (280) not only acts to control the release of the gas phase (38) from the lower wellbore section (34) but may also act as an anchor in order to maintain the position of the apparatus (20) in the wellbore (24).

As stated, the packer (280) is preferably designed to be inflatable and deflatable in order that the apparatus (20) may be placed within and removed from the wellbore (24). In the preferred embodiment the packer (280) is comprised of an inflatable bag (282) which is fixedly connected to one side of a packer plate (284). The other side of the packer plate (284) is connected by screws (286) to the liner (48) such that the packer (280) is contained within the upper wellbore section (32) between the casing (36) and the liner (48) in order that it may seal the space therebetween. Preferably, a conventional gasket (288) is located between the liner (48) and the abutting packer plate (284). As well, the packer (280) defines a packer conduit (290) which extends from the inflatable bag (282) through the packer plate (284), the gasket (288) and the liner (48) to the third liquid conduit (274) in the valving device (54). In addition, the packer plate (284) defines a relief conduit (292) and a relief valve (294). The relief conduit (292) extends from the packer conduit (290) to the relief valve (294). The relief valve (294) is located adjacent the edge of the packer plate (284) so that any gas or liquid contained in the relief conduit (292) or the packer conduit (290) may be exhausted through the relief valve (294) into the upper wellbore section (32).

Finally, the packer conduit (290) includes a one-way valve (296) adjacent the third liquid conduit (274) to perform the function described below. In operation, in order to set the packer (280) within the wellbore (24) such that the space between the casing (36) and the liner (48) is sealed, a gas or liquid is forced under pressure from the surface (26) into the third liquid conduit (274). The gas or liquid in the third liquid conduit (274) flows into the second liquid conduit (194) and comes into contact with the upper valve (84) of the first pump (50). As a result, the gas or liquid is directed to flow into the packer conduit (290) and into the inflatable bag (282). The pressure of the gas or liquid in the third liquid conduit (274) and the packer conduit (290) is increased to a critical level necessary to fully inflate the inflatable bag (282) and seal the space. Once the inflatable bag (282) is fully inflated, the gas or liquid pressure is released and the apparatus (20) is ready for use. The one way valve (296) acts to allow the gas or liquid to flow into the packer conduit (290) from the third liquid conduit (274) but not back into the third liquid conduit (274).

When the apparatus (20) is no longer to be used, the packer (280) may be released by deflating the inflatable bag (282). To deflate the inflatable bag (282), the gas or liquid is again forced into the third liquid conduit (274). When the gas or liquid in the third liquid conduit (274) reaches a second critical level, the relief valve (294) is expelled from the relief conduit (292), which allows the gas or liquid within the inflatable bag (282) to flow into the packer conduit (290) and into the relief conduit (292) for exhausting to the wellbore (24). During the use of the apparatus (20) the pressure within the third liquid conduit (274) from the liquid phase (40) is such that it does not reach the second critical level necessary to act upon the relief valve (294). Although the above embodiment is preferred, any other suitable means for inflating and deflating the inflatable bag (282) from the surface (26) may be used.

Figure 10:
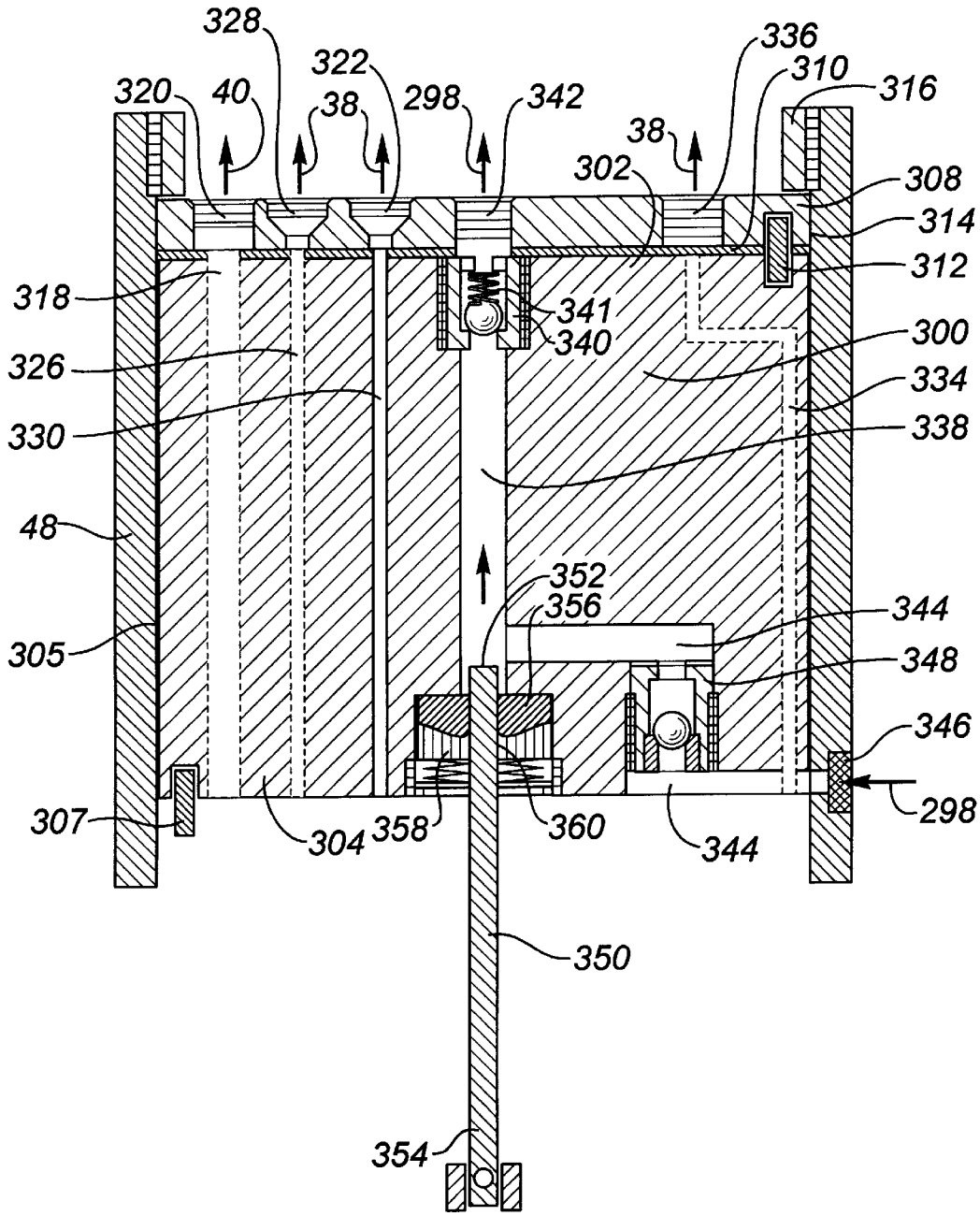
FIG. 10 is a longitudinal sectional view of a second pump of the apparatus.

Referring to FIGS. 1 and 10, the gas phase (38) may be vented from the valving device (54) into the wellbore (24), and specifically into the upper wellbore section (32), which is preferably cased, and directed towards the surface (26). However, as stated, in some circumstances the gas phase (38) may include an amount of a liquid which is carried along with the gas phase (38) rather than forming part of the liquid phase (40). In this case, when the gas phase (38) is released into the upper wellbore section (32), this liquid may fall to the bottom of the upper wellbore section (32) above the packer (280), rather than rise to the surface (26) with the rest of the gas phase (38), and form a condensate liquid (298) within the casing (36) of the upper wellbore section (32).

When a condensate liquid (298) forms or collects above the packer (280) in the upper wellbore section (32), the apparatus (20) is preferably further comprised of means for removing the condensate liquid (298). In the preferred embodiment, the removing means is comprised of a second pump (300) for pumping the condensate liquid (298) towards the surface (26). If the condensate liquid (298) is not pumped to the surface or otherwise removed, it may interfere with the exhausting of the gas phase (38) into the upper wellbore section (32).

Referring to FIGS. 1, 2 and 10. the second pump (300) is preferably contained within the upper wellbore section (32) in communication with the condensate liquid (298). The second pump (300) may be any type of pump capable of pumping the condensate liquid towards the surface, such as a rotary or a reciprocating pump and may be driven by any conventional pump drive. However, the second pump (300) is preferably driven by the pump drive (52) for the first pump (50). Thus, the pump drive (52) concurrently drives both the first and second pumps (50, 300). Further, the second pump (300) is also preferably a reciprocating pump, which operates in the manner described below.

Figure 7:
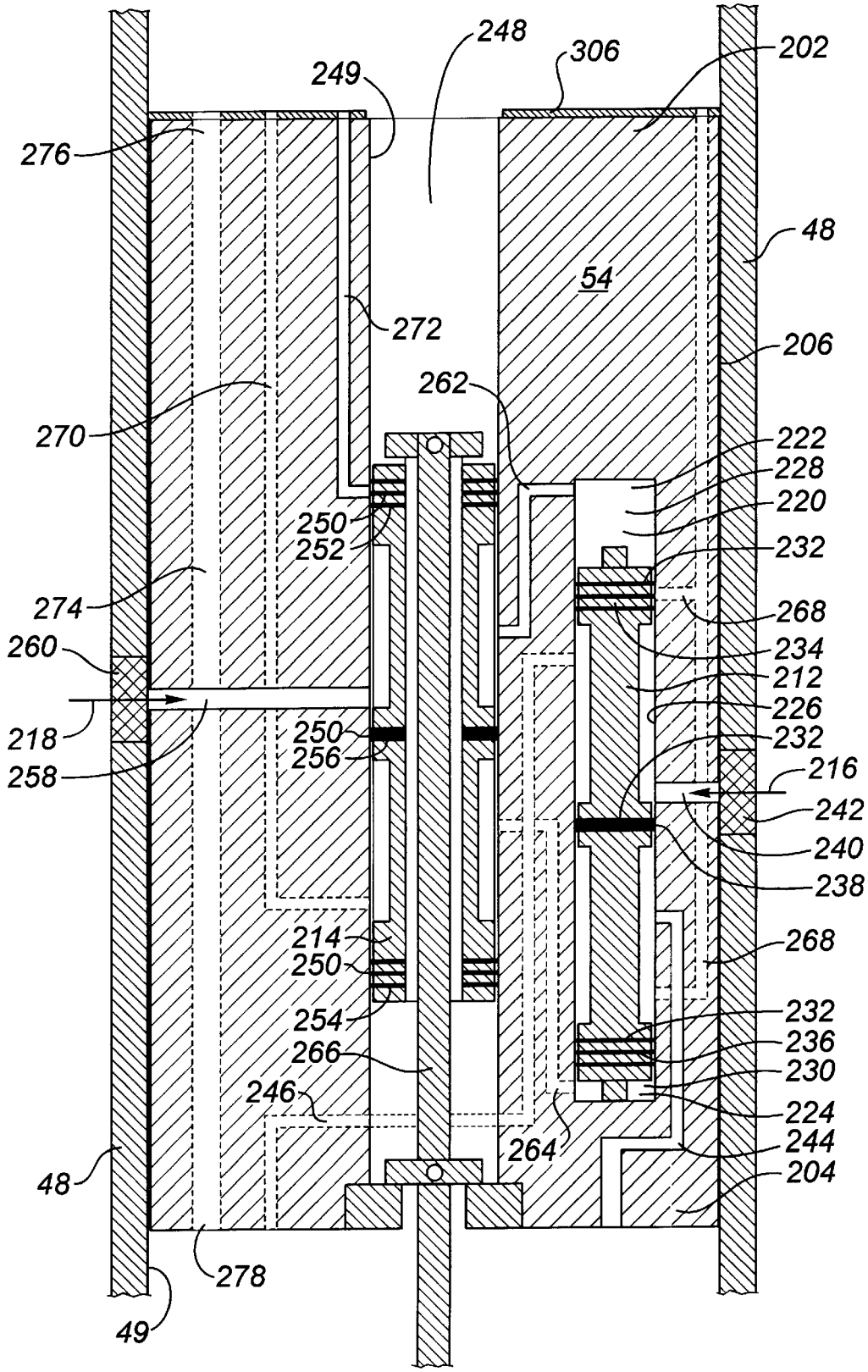
FIG. 7 is a longitudinal sectional view of a valving device of the apparatus.

Referring to FIGS. 2 and 10, the second pump (300) has an upper end (302), a lower end (304) and an outer surface (305). The outer surface (305) makes up a portion of the outer surface (46) of the apparatus (20). The lower end (304) of the second pump (300) preferably abuts against and is aligned with the upper end (202) of the valving device (54), although any other operable arrangement may be used. As shown in FIGS. 2 and 7, a conventional gasket (306) is preferably positioned between the abutting surfaces (202, 304) and the alignment of the abutting surfaces (202, 304) may be maintained by a locating pin (307) extending therebetween (202, 304).

The apparatus (20) may further include a connecting plate (308) located at, and abutting against, the upper end (302) of the second pump (300). A conventional gasket (310) is preferably positioned between the connecting plate (308) and the upper end (302) of the second pump (300) and the alignment of these surfaces (308, 302) is maintained by a locating pin (312) extending therebetween. The connecting plate (308) has an outer surface (314) which is contained within, and preferably abuts against the inner surface (49) of the liner (48). Further, the connecting plate (308) is held in position at the upper end (42) of the apparatus (20) by a retaining ring (316) threadably connected to the inner surface (49) of the liner (48).

Referring to FIGS. 2 and 10, the second pump (300) defines several conduits, all of which preferably extend from the lower end (304) of the second pump (300) to the upper end (302). Specifically, a fourth liquid conduit (318) is aligned with the upper end (276) of the third conduit (274) so that the liquid phase (40) may pass from the third liquid conduit (274) to the fourth liquid conduit (318). At the upper end (302) of the second pump (300), the fourth liquid conduit (318) is aligned with a first liquid vent (320) defined by the connecting plate (308). The first liquid vent (320) threadably engages a liquid line (322), as shown in FIG. 1, which extends from the connecting plate (308) to the surface (26) and preferably to a surface storage tank (324). The liquid line (322) is preferably comprised of a conventional tubing string and may include one or more lines as required for pumping the liquid phase (40) towards the surface (26). Where a second pump (300) is not present in the apparatus (20), the liquid line (322) extends from the valving device (54) to the surface (26).

Further, a fourth exhaust conduit (326) in the second pump (300) is aligned with the second exhaust conduit (270) in the valving device (54) so that the gas phase (38) may pass from the second exhaust conduit (270) into the fourth exhaust conduit (326). At the upper end (302) of the second pump (300), the fourth exhaust conduit (326) is aligned with a first gas vent (328) which is defined by the connecting plate (308). As well, a fifth exhaust conduit (330) in the second pump (300) is aligned with the third exhaust conduit (272) in the valving device (54) so that the gas phase (38) may pass from the third exhaust conduit (272) into the fifth exhaust conduit (330). At the upper end (302) of the second pump (300), the fifth exhaust conduit (330) is aligned with a second gas vent (332) which is defined by the connecting plate (308). The gas phase (38) is then exhausted from the first gas vent (328) and the second gas vent (3320 into the upper wellbore section (34). The upper wellbore section (34) then directs the gas phase (38) towards the surface (26) for venting at the surface (26) or collection in a storage facility (not shown). The upper wellbore section (34) directs the gas phase (38) towards the surface (26) regardless of whether or not the wellbore (24) is cased. However, preferably the wellbore (24) does include the casing (36) in order to minimize the loss of any of the gas phase (38) from the wellbore (24) through the inner wall (30) as it is directed towards the surface (26).

Finally, a sixth exhaust conduit (334) defined by the second pump (300) is aligned with the first exhaust conduit (268) in the valving device (54) so that the gas phase (38) may pass from the first exhaust conduit (268) into the sixth exhaust conduit (334). At the upper end (302) of the second pump (300), the sixth exhaust conduit (334) is aligned with a third gas vent (336) defined by the connecting plate (308). The third gas vent (336) similarly vents into the upper wellbore section (32).

Although the preferred embodiment includes the number of exhaust conduits described herein, two or more of the exhaust conduits may be combined into a single exhaust conduit or one or more of the exhaust conduits may be further divided into a plurality of exhaust conduits. For example, the first, second and third exhaust conduits (268, 270, 272) in the valving device (54) may be comprised of one or more exhaust conduits and the fourth, fifth and sixth exhaust conduits (326, 330, 334) in the second pump (300) may similarly be comprised of one or more exhaust conduits.

The second pump (300) defines a bore (338) for containing the condensate liquid (298), the bore (338) extending from the upper end (302) of the second pump (300) to its lower end (304). The bore (338) contains an upper valve (340), preferably a check valve, adjacent the upper end (302) of the second pump (300). The upper valve (340) is mounted within the bore (338) by a threaded connection and is a standard type one-way check valve. The upper valve (340) is preferably biased by a spring (341) to permit the flow of the condensate liquid (298) out of the bore (338) through the upper valve (340), but not back into the bore (338). The upper valve (340) is aligned with a second liquid vent (342) which is defined by the connecting plate (308). The second liquid vent (342) is threadably engaged either to the liquid line (322), or to a separate liquid line, in order to direct the condensate liquid (298) towards the surface (26). As indicated previously, one or more liquid lines may be connected to the first and second liquid vents (320, 342).

The second pump (300) further defines a fifth liquid conduit (344) which extends from the bore (338) to the outer surface (305) of the second pump (300). The fifth liquid conduit (344) then extends through the liner (48) for communication with the condensate liquid (298) in the upper wellbore section (32). Thus, the condensate liquid (298) may be directed from the upper wellbore section (32) to the bore (338). A conventional liquid filter (346) is contained within the fifth liquid conduit (344) for filtering the condensate liquid (298) as it flows through the fifth liquid conduit (344). In addition, the fifth liquid conduit (344) includes a lower valve (348), preferably a conventional one-way check valve, for controlling the flow of the condensate liquid (298) into and out of the bore (338). The lower valve (348) permits the flow of the condensate liquid (298) from the upper wellbore section (32) to the bore (338) of the second pump (300), but not from the bore (338) back into the upper wellbore section (32).

The second pump (300) is further comprised of a second pump shaft (350), having an upper end (352) and a lower end (354), located within the bore (338) of the second pump (300). The second pump shaft (350) is longitudinally moveable within the bore (338) such that the second pump shaft (350) may reciprocate within the bore (338), which alternately moves the upper end (352) away from and towards the upper valve (340) in the second pump (300). The second pump shaft (350) is operably connected to the valve drive shaft (266) such that reciprocation of the valve drive shaft (266) by the main valve (214) causes the second pump shaft (350) to reciprocate within the bore (338). Movement of the upper end (352) of the second pump shaft (350) downwards, away from the upper valve (340), initiates a suction or negative pressure within the bore (338) which closes the upper valve (340) and opens the lower valve (348) to draw the condensate liquid (298) from the upper wellbore section (32) into the fifth liquid conduit (344), through the lower valve (348), and into the bore (338). Movement of the upper end (342) of the second pump shaft (350) upwards, towards the upper valve (340), closes the lower valve (348) and acts against the spring (341) of the upper valve (340) to open the upper valve (340) and thus cause the condensate liquid (298) in the bore (338) to discharge from the bore (338) through the second liquid vent (342).

A conventional seal (356) is contained within the bore (338) at the lower end (304) of the second pump (300). The seal (356) includes packing (358) which defines an aperture (360) for the passage of the second pump shaft (350) therethrough. The packing (358) is intended to form a seal against the second pump shaft (350) in order to inhibit the passage of the condensate liquid (298) out of the bore (338) into the valving device (54).

As indicated previously, the within invention is also directed at a method for producing reservoir fluids from an underground reservoir, and can be used with the preferred embodiment of the invention in its apparatus form, or with other apparatus. The method is comprised of intaking the gas phase (38) from the wellbore (24) into the pump drive (52) in order to power the pump drive (52), powering the pump drive (52) using the gas pressure of the gas phase (38) in the wellbore (24), and exhausting the gas phase (38) from the pump drive (52) towards the surface (26). Performance of the intaking, powering and exhausting steps results in the pumping of the liquid phase (40) from the wellbore (24) towards the surface (26) as a result of the driving of the first pump (50) by the pump drive (52).

Using the preferred embodiment apparatus, the powering step is comprised of alternately first moving the primary and supplementary pistons (174, 184), by the gas pressure of the first flow (216) of the gas phase (38), from the first position to the second position and second moving the primary and supplementary pistons (174, 184) from the second position to the first position. Performance of the first and second moving steps results in reciprocation of the primary draft shaft (122) and the supplementary drive shaft (158) which reciprocates the first pump shaft (90) to pump the liquid phase (40) towards the surface (26).

Further, the intaking step is preferably comprised of the steps of alternately first directing the first flow (216) of the gas phase (38) from the lower wellbore section (34) into the upper chamber sections (180, 186) of the primary and supplementary chambers (114, 150) and second directing the first flow (216) from the lower wellbore section (34) into the lower chamber sections (182, 188) of the primary and supplementary chambers (114, 150). As a result of the first directing step, the gas pressure moves the primary and supplementary pistons (174, 184) from the first position to the second position to perform the first moving step. As a result of the second directing step, the gas pressure moves the primary and supplementary pistons (174, 184) from the second position to the first position to perform the second moving step. Finally, the intaking step is preferably further comprised of guiding the second flow (218) of the gas phase (38) from the lower wellbore section (34) to the switching valve (212) in order to actuate the switching valve (212).

Using the preferred embodiment apparatus, the method is also comprised of the step of controlling the release of the gas phase (38) from the wellbore (24) so that the gas phase (38) is available for the performance of the powering step. The controlling step is preferably performed by the packer (280) as described above. Where the apparatus (20) includes the packer (280), the exhausting step is comprised of directing the gas phase (38) from the pump drive (52) past the packer (280) towards the surface (26). The exhausting step is also preferably comprised of the step of releasing the gas phase (38) from the pump drive (52) into the upper wellbore section (32) so that the casing (36) in the upper wellbore section (32) may direct the gas phase (38) towards the surface (26).

Finally, the method is preferably further comprised of the step of pumping the condensate liquid (298) from the upper wellbore section (32) towards the surface (26) by the second pump (300).

The specific design parameters of the apparatus (20), including the preferred number of drivers included in the pump drive (52), are dependant upon the particular operating conditions of the apparatus (20) in the wellbore (24) such as the depth of the apparatus (20) beneath the surface (26), the gas pressure of the gas phase (38), the flow rate of the gas phase (38) into the wellbore (24), the volume of the liquid phase (40) to be pumped from the wellbore (24) and other characteristics of the reservoir fluids contained in the underground reservoir (22). The specific design parameters of the apparatus (20) must therefore be chosen to be compatible with the particular conditions under which the apparatus (20) is to operate such that the pump drive (52) generates sufficient power using the gas pressure of the gas phase (38) to drive the first pump (50), and the second pump (300) in the preferred embodiment, and to pump the liquid phase (40) towards the surface (26).

In some circumstances, it may not be possible to design a compatible apparatus (20) if the gas pressure or the volume of the gas phase (38) in the wellbore (24) are insufficient to drive the pump drive (52) sufficiently to pump the liquid phase (40) towards the surface. Alternatively, it may not be desirable to pump the liquid phase (40) towards the surface or to direct the gas phase (38) towards the surface. In such circumstances, the liquid phase (40) may be pumped towards a downhole location. The gas phase (38) may also be directed towards a downhole location and any condensate liquid (298) may also be pumped towards a downhole location.

The embodiments of the invention in which an exclusive property or privilege is claimed are defined as follows:

1. An apparatus for moving reservoir fluids from an underground reservoir using a wellbore having an inner wall and extending from the surface to an end beneath the surface, wherein the wellbore communicates with the reservoir such that the reservoir fluids enter the wellbore and separate into a liquid phase and a gas phase at a gas pressure, the apparatus comprising:

(a) a first pump for pumping the liquid phase, wherein the first pump is containable within the wellbore in communication with the liquid phase;

(b) a pump drive operably connected to the first pump, for driving the first pump, wherein the pump drive is containable within the wellbore and wherein the pump drive is powered using the gas pressure of the gas phase in the wellbore and wherein the pump drive is comprised of a turbine having a rotary drive shaft extending longitudinally therethrough which is powered using the gas pressure of the gas phase in the wellbore, the rotary drive shaft being operably connected to the first pump such that rotation of the drive shaft drives the first pump in order to pump the liquid phase;

(c) an intake for communicating with the gas phase in the wellbore and for directing the gas phase to the pump drive in order to power the pump drive;

(d) an exhaust for directing the gas phase from the pump drive; and (e) means, associated with the wellbore, for controlling the release of the gas phase within the wellbore so that the gas phase is available to power the pump drive.

2. The apparatus as claimed in claim 1 wherein the first pump is a rotary pump having a first pump shaft operably connected to the drive shaft such that rotation of the drive shaft rotates the first pump shaft to pump the liquid phase.

3. The apparatus as claimed in claim 1 wherein the exhaust directs the gas phase towards the surface.

4. The apparatus as claimed in claim 3 wherein the first pump pumps the liquid phase towards a location outside the wellbore.

5. The apparatus as claimed in claim 4 wherein the first pump pumps the liquid phase towards the surface.

6. The apparatus as claimed in claim 2 wherein the wellbore is comprised of a lower wellbore section adjacent the end of the wellbore for containing the first pump and the pump drive and which communicates with the reservoir, and an upper wellbore section which extends from the lower wellbore section to the surface, and wherein the controlling means is comprised of a packer sealingly engaging the inner wall of the wellbore between the upper wellbore section and the lower wellbore section.

7. The apparatus as claimed in claim 6 wherein the exhaust directs the gas phase from the pump drive past the packer.

8. The apparatus as claimed in claim 7 wherein the wellbore is further comprised of a casing, which lines the inner wall of the wellbore and defines a plurality of perforations in the lower wellbore section for communication between the reservoir and the lower wellbore section, and wherein the exhaust is comprised of at least one exhaust conduit which releases the gas phase from the pump drive into the upper wellbore section.

9. The apparatus as claimed in claim 8 wherein the apparatus is further comprised of a second pump, for containing within the upper wellbore section, for pumping a condensate liquid contained in the upper wellbore section.

10. The apparatus as claimed in claim 9 wherein the second pump is driven by the pump drive.

* * * * *